US011764525B2

(12) United States Patent
Endo et al.

(10) Patent No.: US 11,764,525 B2
(45) Date of Patent: Sep. 19, 2023

(54) ELECTRICAL CONNECTOR

(71) Applicant: MITSUMI ELECTRIC CO., LTD., Tama (JP)

(72) Inventors: Kazuma Endo, Tama (JP); Hiroyuki Sadohara, Tama (JP); Takahiro Kanda, Tama (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/653,089

(22) Filed: Mar. 1, 2022

(65) Prior Publication Data

US 2022/0311192 A1 Sep. 29, 2022

(30) Foreign Application Priority Data

Mar. 25, 2021 (JP) ..... 2021-50939

(51) Int. Cl.

| | |
|---|---|
| ***H01R 24/40*** | (2011.01) |
| ***H01R 13/24*** | (2006.01) |
| ***H01R 13/504*** | (2006.01) |
| ***H01R 13/516*** | (2006.01) |
| ***H01R 12/72*** | (2011.01) |

(52) U.S. Cl.

CPC ..... *H01R 24/40* (2013.01); *H01R 13/24* (2013.01); *H01R 13/5045* (2013.01); *H01R 13/516* (2013.01); *H01R 12/724* (2013.01)

(58) Field of Classification Search

CPC ..... H01R 24/40; H01R 13/24; H01R 13/516; H01R 13/5045; H01R 13/41; H01R 9/053

See application file for complete search history.

(56) References Cited

U.S. PATENT DOCUMENTS

| | | | | |
|---|---|---|---|---|
| 6,887,112 | B2 * | 5/2005 | Kuroki | H01R 12/716 439/752 |
| 2015/0011103 | A1 | 1/2015 | Yu et al. | |
| 2020/0083624 | A1 | 3/2020 | Nagasaka et al. | |
| 2021/0098922 | A1 * | 4/2021 | Phatiwuttipat | H01R 43/20 |

FOREIGN PATENT DOCUMENTS

| | | | |
|---|---|---|---|
| JP | 2019012635 | A | 1/2019 |
| WO | 2019188027 | A1 | 10/2019 |

OTHER PUBLICATIONS

European Patent Office, Extended European Search Report Issued in Application No. 22157338.9, dated Jul. 19, 2022, Germany, 8 pages.

* cited by examiner

*Primary Examiner* — Briggitte R. Hammond
(74) *Attorney, Agent, or Firm* — McCoy Russell LLP

(57) ABSTRACT

An electrical connector includes contact pins, insulating housings for containing the contact pins therein and metallic outer contacts for respectively covering the housings. Each of the contact pins includes a horizontally extending portion, a contact portion, a connection portion, a downwardly extending portion and a press-fitting shoulder extending from a side portion of a base end portion of the horizontally extending portion in a width direction thereof. A width of the press-fitting shoulder of each of the contact pins decreases from a base side toward a tip side.

3 Claims, 20 Drawing Sheets

ELECTRICAL CONNECTOR

CROSS-REFERENCE TO RELATED APPLICATION

The present application claims priority to Japanese Patent Application No. 2021-050939 filed on Mar. 25, 2021. The entire contents of the above-listed application are hereby incorporated by reference for all purposes.

TECHNICAL FIELD

The present disclosure generally relates to electrical connectors, in particular to an electrical connector used for providing a coaxial connection with a coaxial cable.

BACKGROUND

In order to provide an electrical connection between an electronic device and another electronic device through a cable, a combination of a receptacle connector and a plug connector has been widely used. Further, an amount of data transmitted from the electronic device to the other electronic device through the cable has increased as processing capacity of the electronic devices has been improved in recent years. In order to transmit a large amount of data in a short time, it is necessary to transmit a high-frequency signal through the cable. Thus, there are needs of improving signal transmission characteristics of the cable, particularly, signal transmission characteristics of the cable in a high-frequency band. In order to address such needs, a coaxial cable having high signal transmission characteristics in the high frequency band has been widely used. As is well known, the coaxial cable has a coaxial structure in which a core wire for transmitting a signal, an inner insulator layer covering the core wire, an outer conductor layer (a braid layer) covering the inner insulator layer and an outer insulator layer covering the outer conductor layer are concentrically arranged.

In order to provide a coaxial connection with the above-mentioned coaxial cable, there has been widely used an electrical connector including a contact pin which should be electrically connected to the core wire of the coaxial cable, an insulating housing covering the contact pin and an outer contact which covers the housing and should be connected to the outer conductor layer of the coaxial cable (for example, see patent document 1). FIG. 1 illustrates a housing 10 and a contact pin 11 typically used in the above-mentioned electrical connector. The housing 10 is an L-shaped member including a cylindrical portion 101 extending in a longitudinal direction thereof and a downwardly extending portion 102 extending from a base end portion of the cylindrical portion 101 toward the lower side. An insertion hole 103 is formed at the cylindrical portion 101 of the housing 10 so as to pass through the cylindrical portion 101 in the longitudinal direction. The contact pin 11 includes a horizontally extending portion 111 which linearly extends in the longitudinal direction and is held in the cylindrical portion 101 of the housing 10, a contact portion 112 which protrudes from a tip end portion of the horizontally extending portion 111 toward the tip side and should be contacted with a corresponding contact pin of a mating connector, a connection portion 113 which is curved from a base end portion of the horizontally extending portion 111 so as to extend toward the lower side, a downwardly extending portion 114 extending from a lower end portion of the connection portion 113 toward the lower side and a terminal portion 115 which is formed at a lower end portion of the downwardly extending portion 114 and should be connected to a corresponding terminal of a circuit board.

In order to hold the contact pin 11 with the housing 10, it is necessary to press-fit the contact pin 11 into the insertion hole 103 of the housing 10 as shown in FIG. 1. In order to enable the press-fitting of the contact pin 11 into the insertion hole 103 of the housing 10, a pair of press-fitting shoulders 116 are formed at the base end portion of the horizontally extending portion 111 of the contact pin 11. Since the pair of press-fitting shoulders 116 are formed at the base end portion of the horizontally extending portion 111, it becomes possible to press-fit the contact pin 11 into the insertion hole 103 of the housing 10 by using a press-fitting tool 12 as shown in FIG. 2.

FIG. 2 is a schematic diagram for explaining a method of press-fitting the contact pin 11 into the insertion hole 103 of the housing 10. As shown in FIG. 2, the press-fitting tool 12 is used for press-fitting the contact pin 11 into the insertion hole 103 through a press-fitting window 104 formed at a base end portion of the cylindrical portion 101 of the housing 10 so as to open toward the base side. The press-fitting tool 12 includes a pair of protrusions 121 for respectively pressing the pair of press-fitting shoulders 116 of the contact pin 11. Each of the protrusions 121 of the press-fitting tool 12 is a rod-like portion which has a diameter for enabling the protrusion 121 to be inserted into the press-fitting window 104 of the housing 10 and protrudes toward the tip side. The pair of protrusions 121 of the press-fitting tool 12 can respectively press the pair of press-fitting shoulders 116 of the contact pin 11 to press-fit the contact pin 11 into the insertion hole 103 of the housing 10. As described above, it is necessary to provide the pair of press-fitting shoulders 116 at the base end portion of the horizontally extending portion 111 of the contact pin 11 in the electrical connector for providing the coaxial connection with the coaxial cable.

However, a terminal diameter (width) of the contact pin 11 increases at a portion where the press-fitting shoulders 116 are formed. Thus, there is a problem that an impedance of the portion where the press-fitting shoulders 116 of the contact pin 11 are formed is lowered. As a result, signal transmission characteristics of the electrical connector, in particular, signal transmission characteristics in the high-frequency band deteriorates.

RELATED ART DOCUMENT

Patent Document

Patent document 1: JP 2019-12635A

SUMMARY

Problem to be Solved by the Disclosure

The present disclosure has been made in view of the above-described problem of the conventional art. Accordingly, it is an object of the present disclosure to suppress the deterioration of the signal transmission characteristics caused by the press-fitting shoulders of the contact pin of the electrical connector for providing the coaxial connection with the coaxial cable, thereby improving the signal transmission characteristics of the electrical connector.

Means for Solving the Problems

The above object is achieved by the present disclosures defined in the following (1) to (6).

An electrical connector which can be coupled with a mating connector inserted from a tip side, comprising:

a contact pin;

an insulating housing for containing the contact pin therein; and a metallic outer contact for covering the housing, wherein the contact pin includes:

a horizontally extending portion which is located in the housing and linearly extends in an insertion and extraction direction of the mating connector, a contact portion which linearly extends from a tip end portion of the horizontally extending portion toward the tip side so as to be exposed from the housing, a connection portion which is curved from a base end portion of the horizontally extending portion so as to extend toward a lower side, a downwardly extending portion which linearly extends from a lower end portion of the connection portion toward the lower side, and at least one press-fitting shoulder which extends from a side portion of the base end portion of the horizontally extending portion in a width direction perpendicular to the insertion and extraction direction of the mating connector, and wherein a width of the at least one press-fitting shoulder of the contact pin decreases from a base side toward the tip side.

The electrical connector according to the above (1), wherein the housing includes a cylindrical portion linearly extending in the insertion and extraction direction of the mating connector and a downwardly extending portion extending from a base end portion of the cylindrical portion toward the lower side, wherein the cylindrical portion of the housing includes an insertion hole through which the contact pin is passed and a concave portion formed on a base end surface of the cylindrical portion so as to open toward the base side and communicate with the insertion hole, and wherein the at least one press-fitting shoulder of the contact pin is contained in the concave portion of the cylindrical portion of the housing.

(3) The electrical connector according to the above (2), wherein the concave portion of the cylindrical portion of the housing is defined by a bottom surface directed toward the base side and wall portions extending from the bottom surface toward the base side, and wherein the at least one press-fitting shoulder of the contact pin faces the bottom surface of the concave portion of the cylindrical portion of the housing through a gap therebetween, and thereby an air layer exists between the at least one press-fitting shoulder of the contact pin and the bottom surface of the concave portion of the cylindrical portion of the housing.

(4) The electrical connector according to the above (3), wherein the bottom surface of the concave portion of the cylindrical portion of the housing is a flat surface perpendicular to the insertion and extraction direction of the mating connector.

(5) The electrical connector according to the above (3) or (4), a base end portion of the at least one press-fitting shoulder of the contact pin protrudes from the concave portion of the cylindrical portion of the housing toward the base side.

(6) The electrical connector according to any one of the above (1) to (5), wherein the width of the at least one press-fitting shoulder of the contact pin gradually decreases from the base side toward the tip side.

Effect of the Disclosure

In the present disclosure, the width of the press-fitting shoulder of the contact pin of the electrical connector decreases from the base side toward the tip side. Therefore, it is possible to suppress decrease of an impedance of a portion where the press-fitting shoulder of the contact pin is formed, thereby providing the electrical connector having improved signal transmission characteristics.

DETAILED DESCRIPTION

Figure 1:
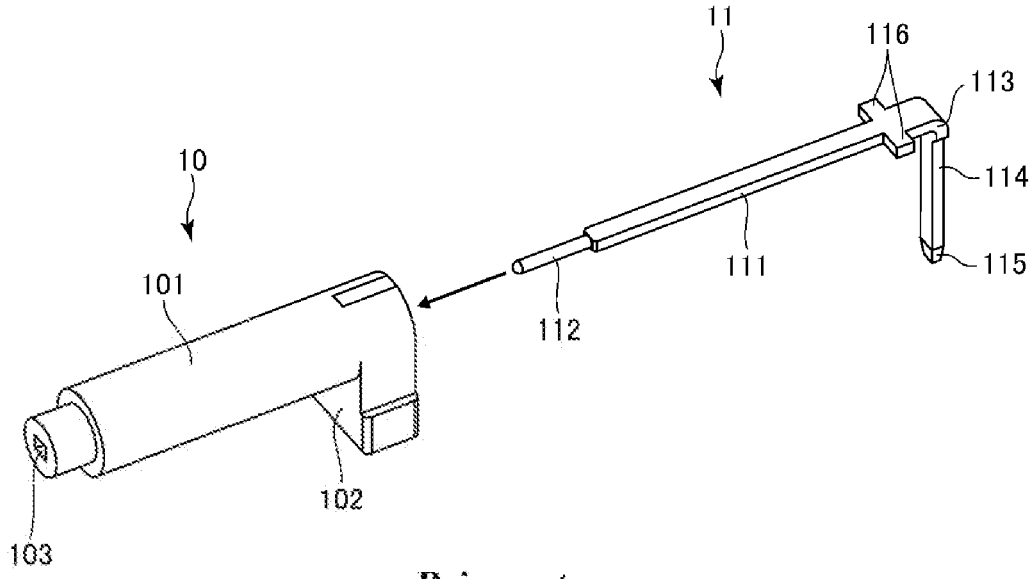
Prior art Fig. 1
FIG. 1 is a perspective view showing a housing and a contact pin typically used in a conventional electrical connector.

Hereinafter, an electrical connector of the present disclosure will be described with reference to an embodiment shown in the accompanying drawings. Note that each of the figures referred in the following description is a schematic diagram prepared for explaining the present disclosure. A dimension (such as a length, a width and a thickness) of each component shown in the drawings is not necessarily identical to an actual dimension. Further, the same reference numbers are used throughout the drawings to refer to the same or similar elements. In the following description, the positive direction of the Z-axis in each figure may be referred to as "a tip side" or "a front side", the negative direction of the Z-axis in each figure may be referred to as "a base side" or "a rear side", the positive direction of the Y-axis in each figure may be referred to as "an upper side", the negative direction of the Y-axis in each figure may be referred to as "a lower side", the positive direction of the X-axis in each figure may be referred to as "a near side" and the negative direction of the X-axis in each figure may be referred to as "a far side". Further, the Z direction may be referred to as "an insertion and extraction direction of a mating connector", the Y direction may be referred to as "a height direction" and the X direction may be referred to as "a width direction".

Figure 3:
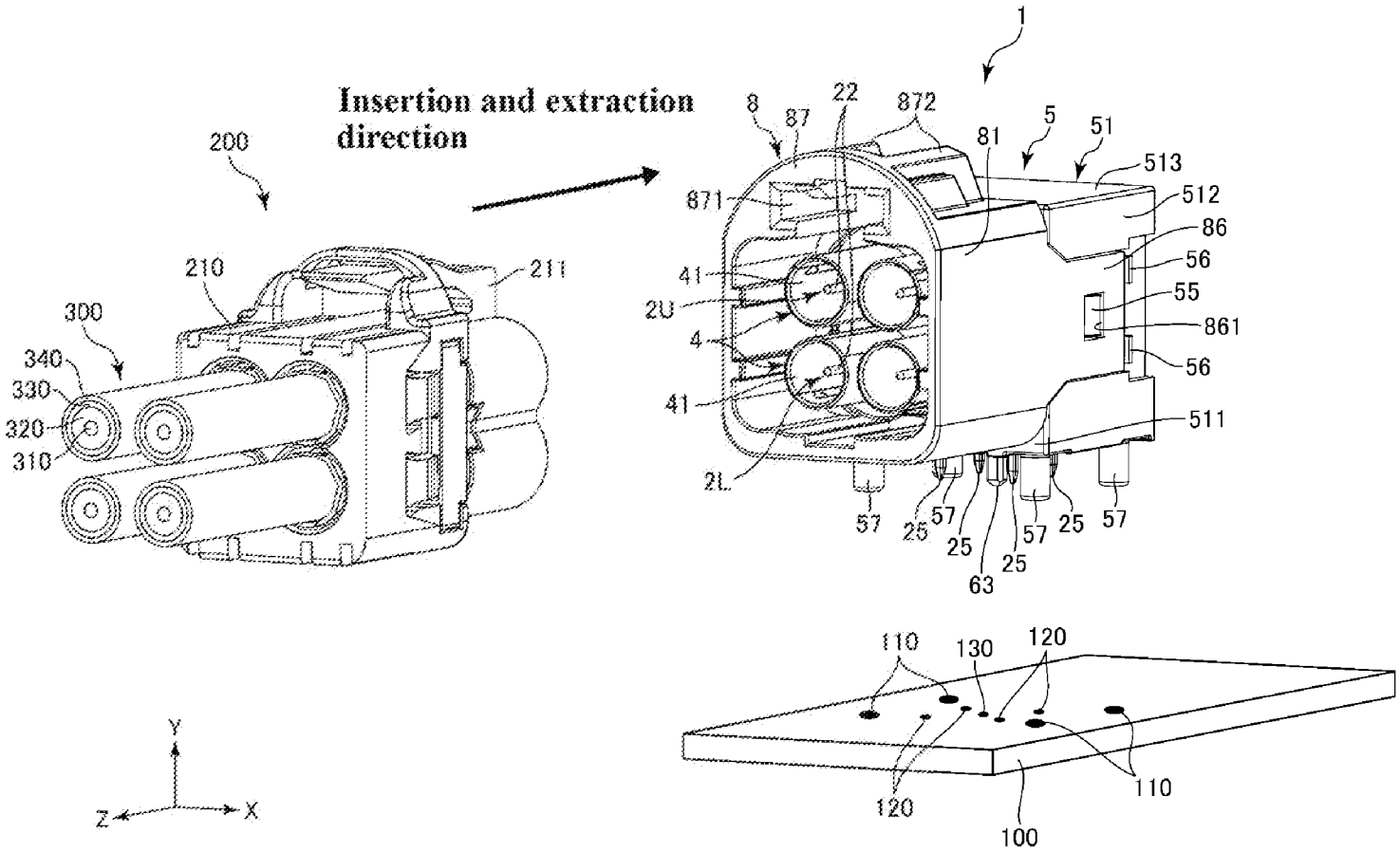
FIG. 3 is a perspective view showing an electrical connector of the present disclosure, a circuit board on which the electrical connector of the present disclosure should be mounted and a mating connector which should be connected with the electrical connector of the present disclosure.
Figure 4:
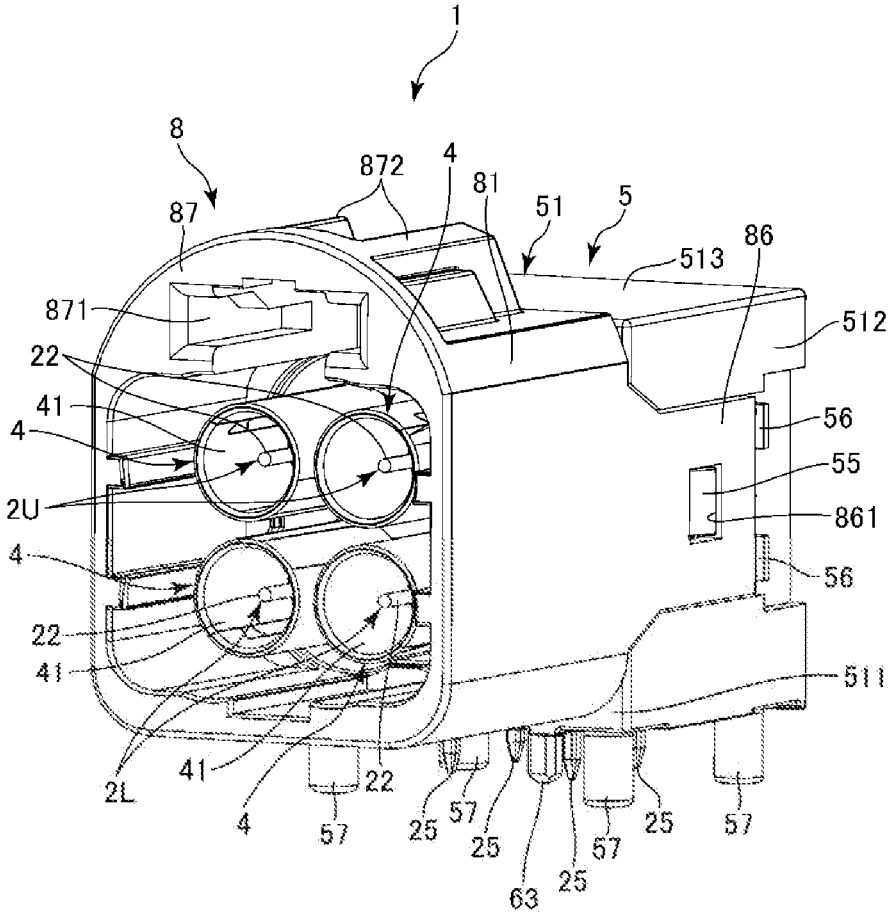
FIG. 4 is a perspective view of the electrical connector shown in FIG. 3.
Figure 4:
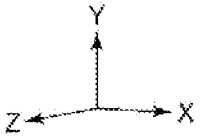
Figure 5:
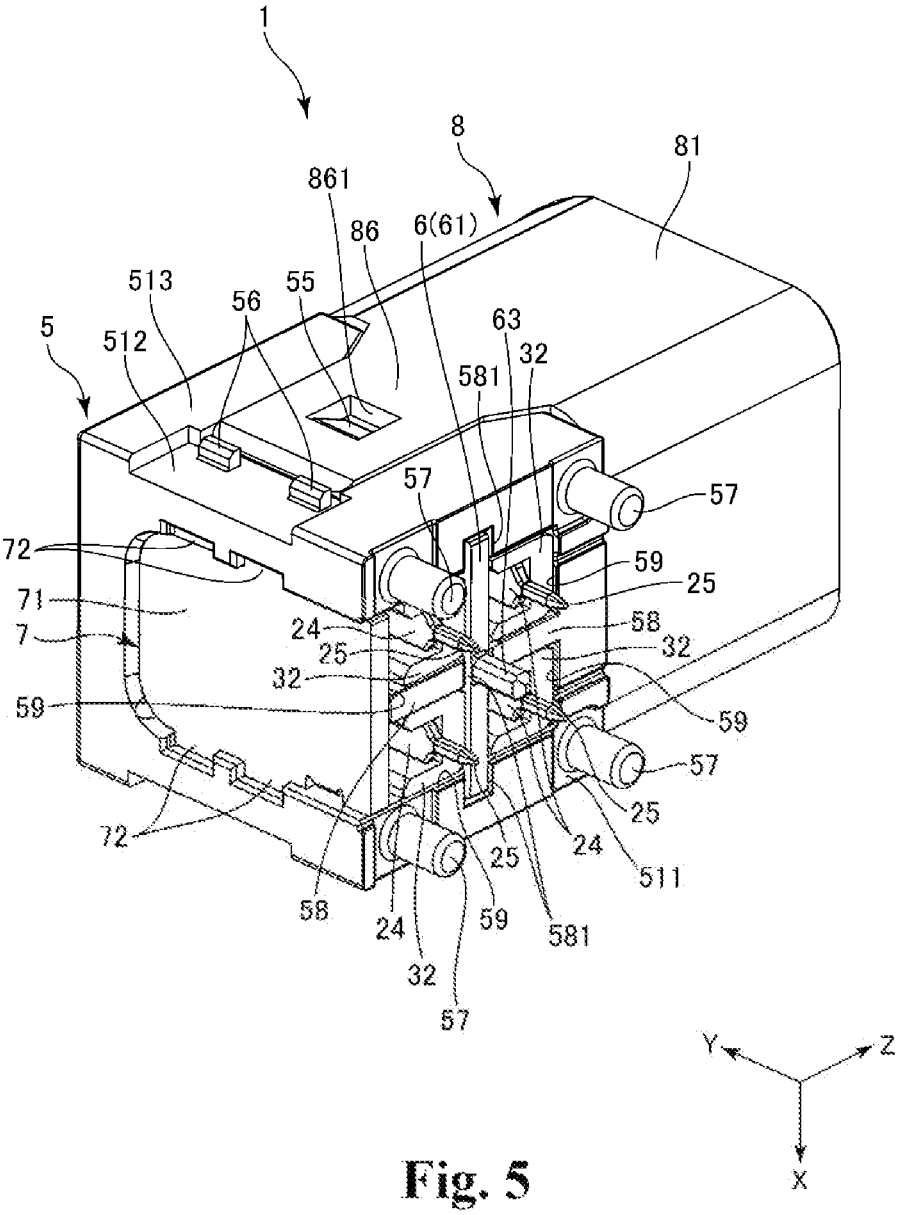
FIG. 5 is another perspective view of the electrical connector shown in FIG. 3 viewed from another angle.
Figure 6:
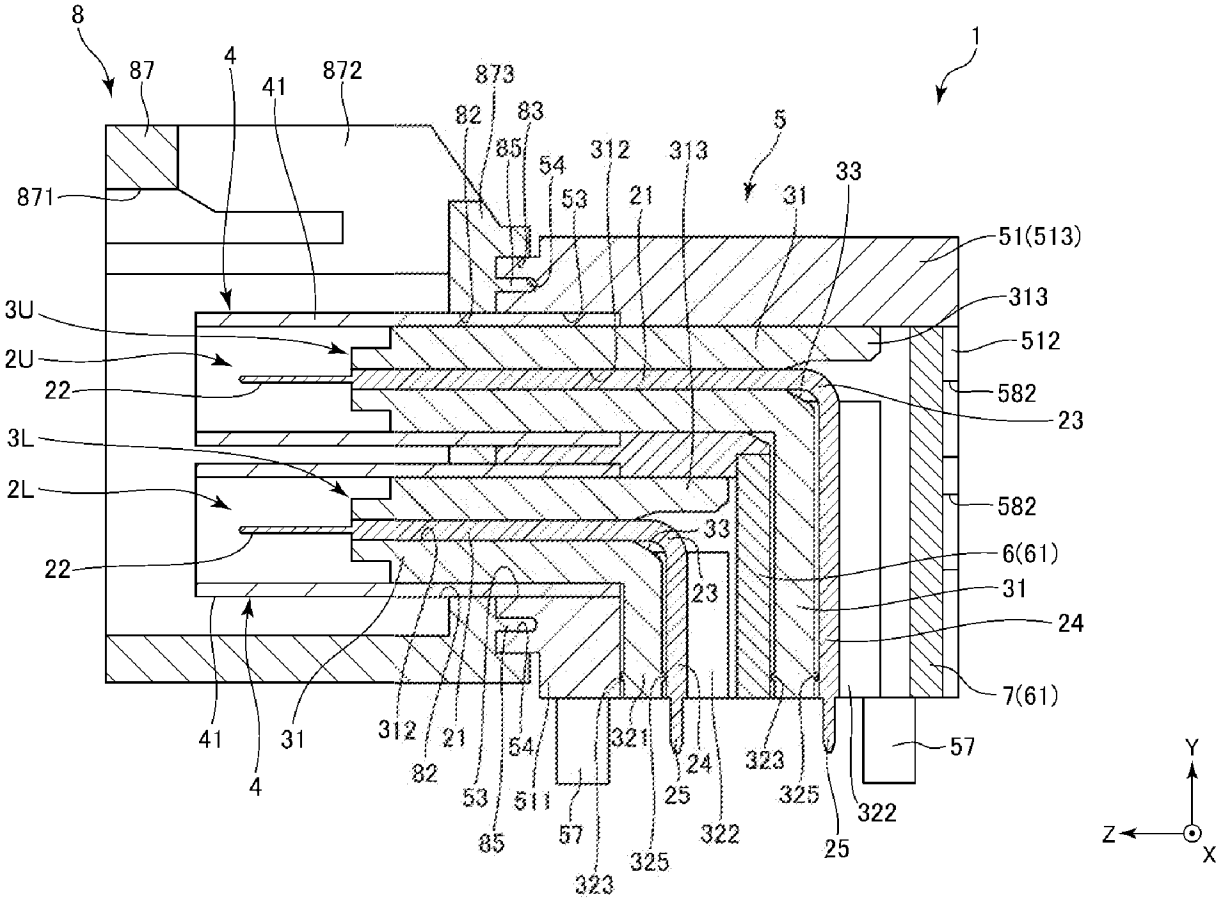
FIG. 6 is a YZ plane cross-sectional view containing an upper contact pin and a lower contact pin of the electrical connector shown in FIG. 3.
Figure 7:
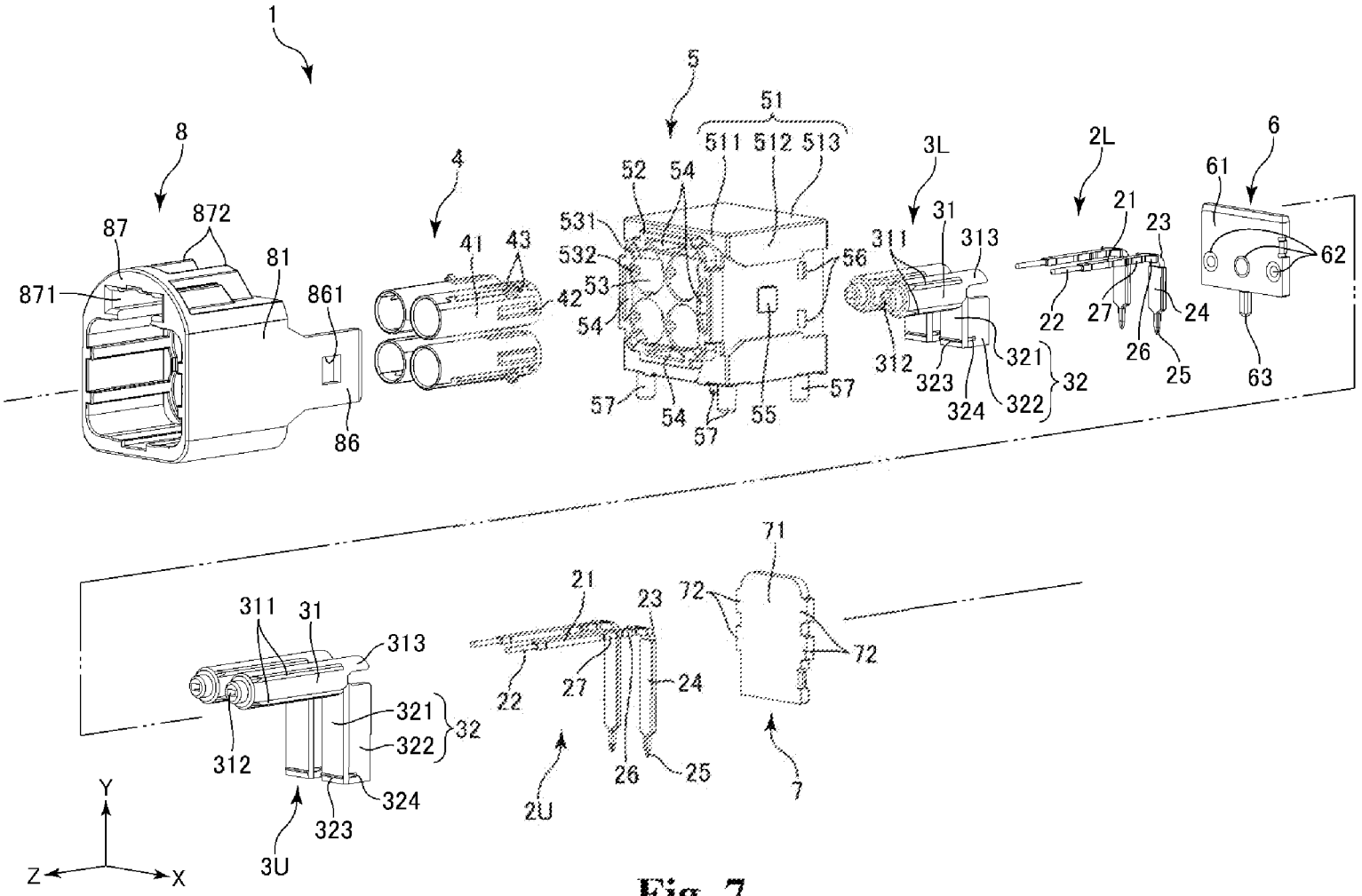
FIG. 7 is an exploded perspective view of the electrical connector shown in FIG. 3.
Figure 8:
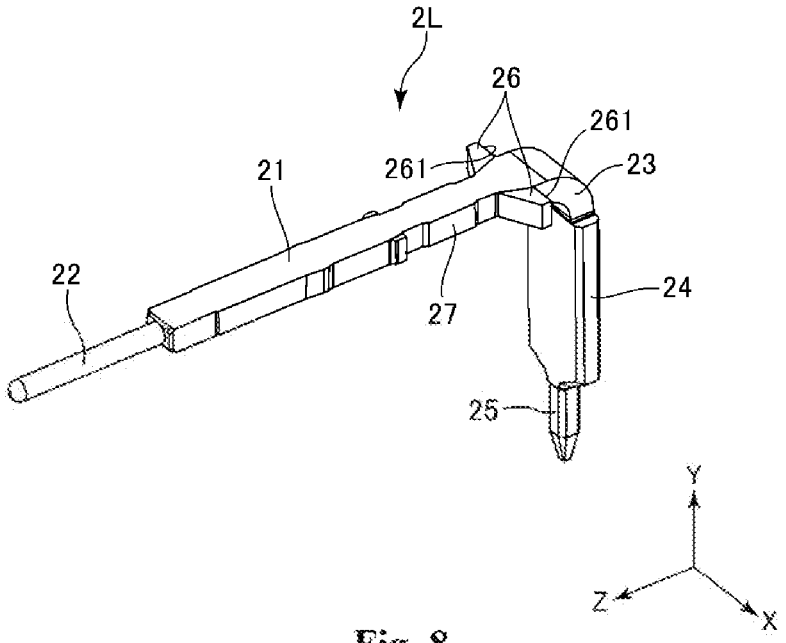
FIG. 8 is a perspective view of the lower contact pin.
Figure 9:
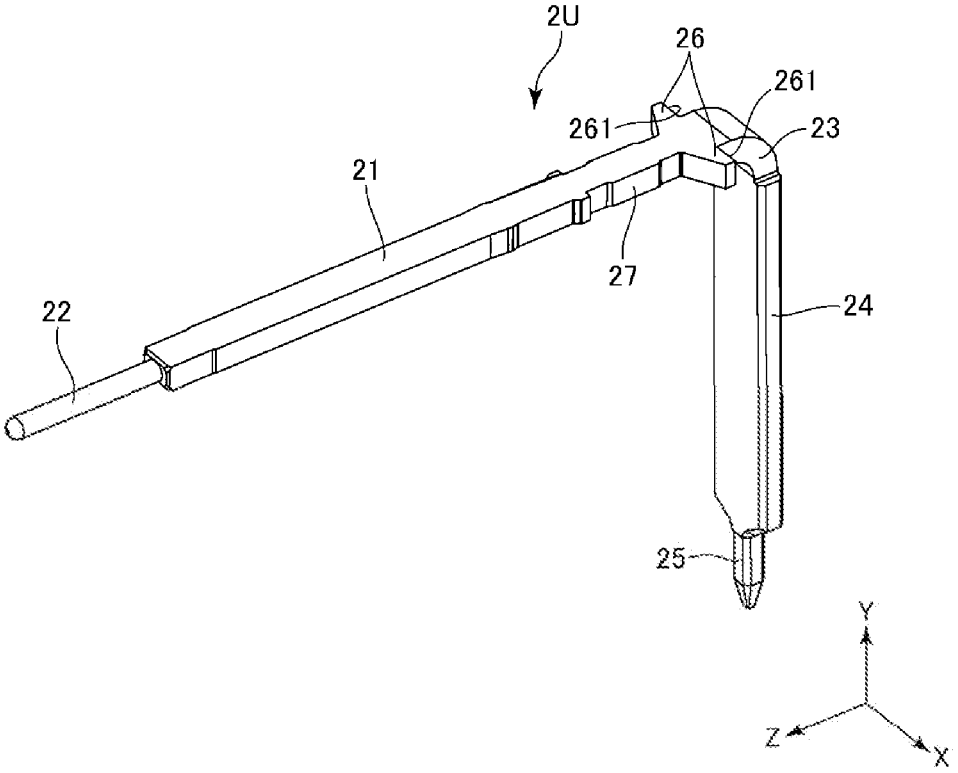
FIG. 9 is a perspective view of the upper contact pin.
Figure 10A:
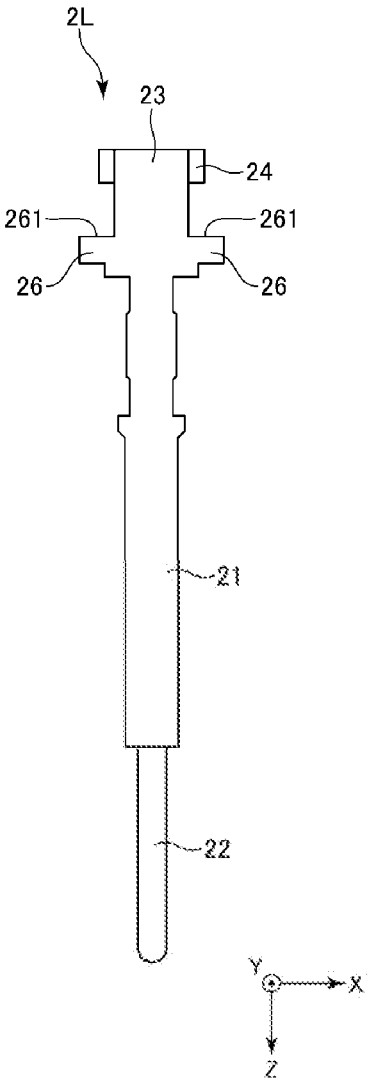
FIG. 10A is a view showing a modified example of the lower contact pin.
Figure 10B:
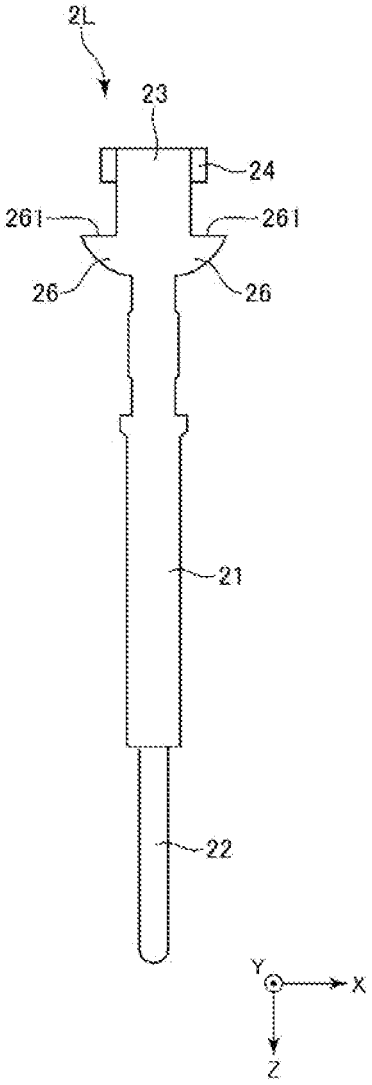
FIG. 10B is another view showing another modified example of the lower contact pin.
Figure 11:
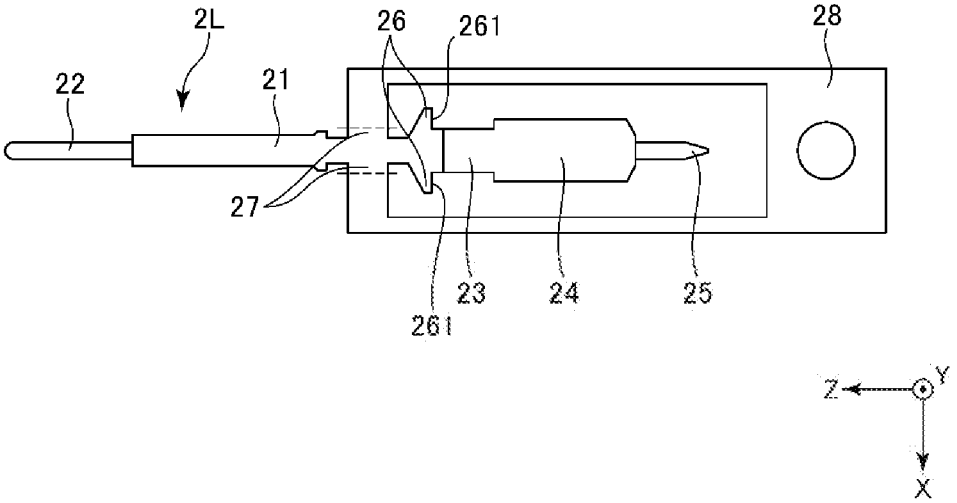
FIG. 11 is a planar view showing a work-in-process of the lower contact pin.
Figure 12:
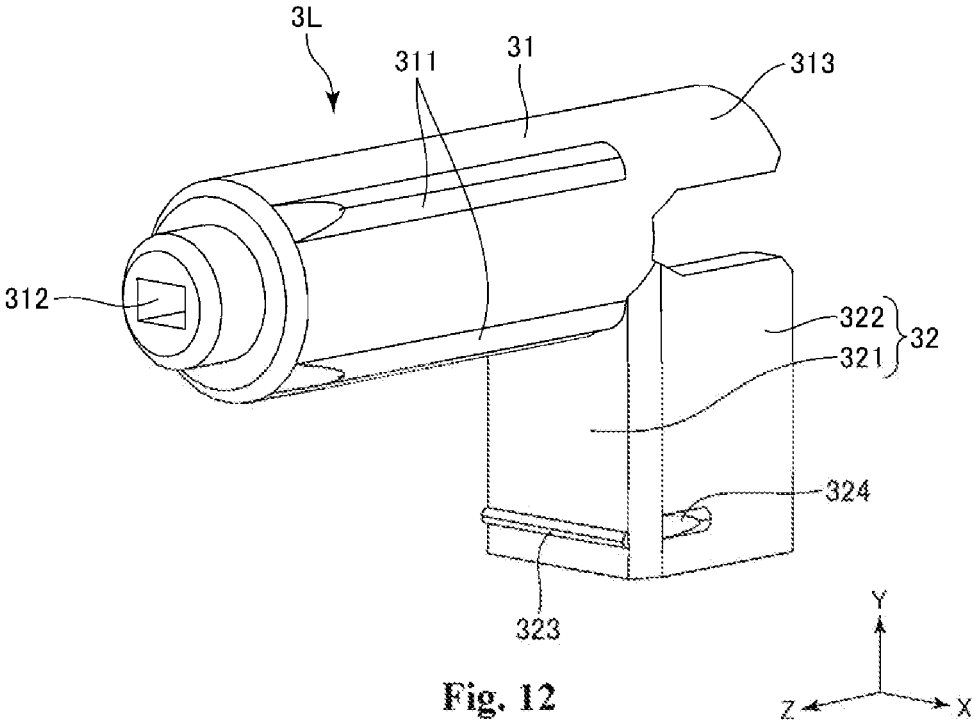
FIG. 12 is a perspective view of a lower housing.
Figure 13:
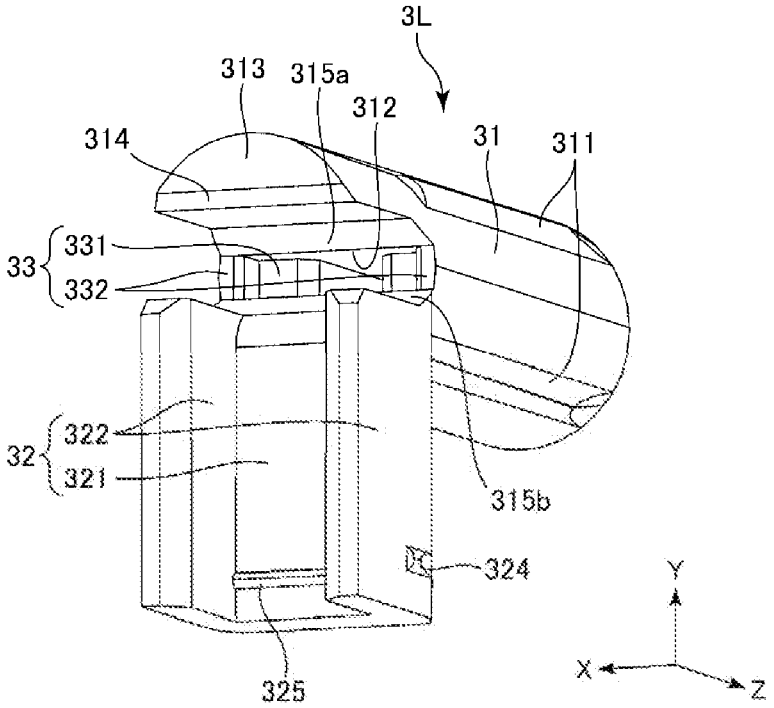
FIG. 13 is another perspective view of the lower housing viewed from another angle.
Figure 14:
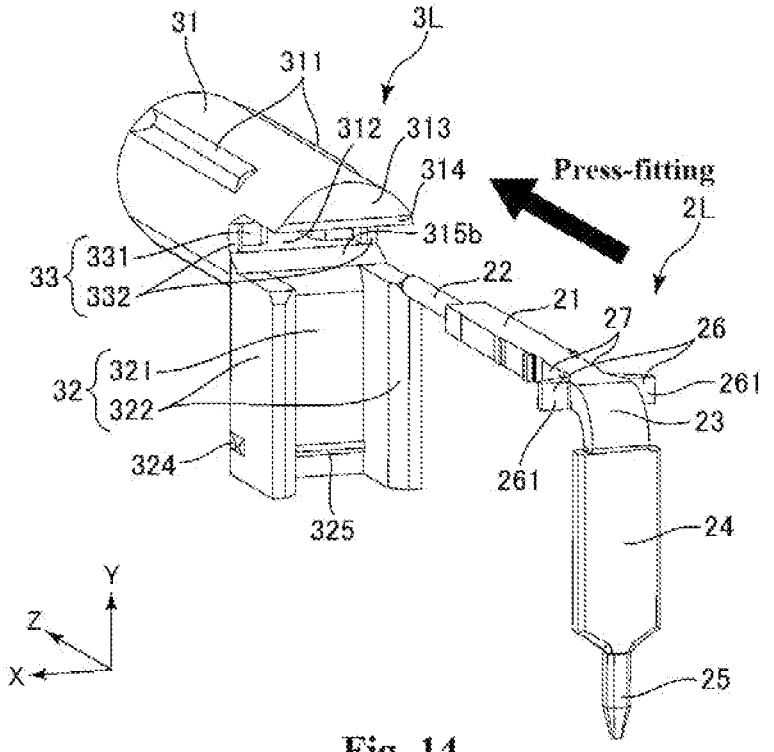
FIG. 14 is a perspective view for explaining a method of press-fitting the lower contact pin into the lower housing.
Figure 15:
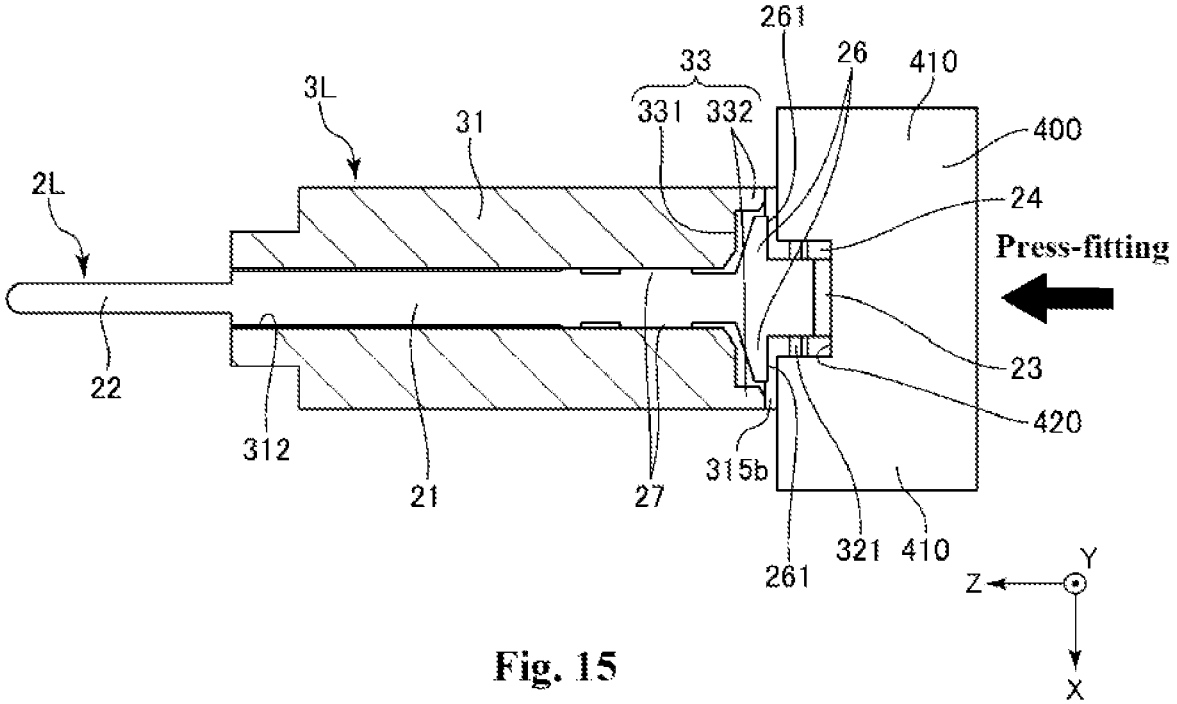
FIG. 15 is a schematic diagram for explaining the method of press-fitting the lower contact pin into the lower housing.
Figure 16:
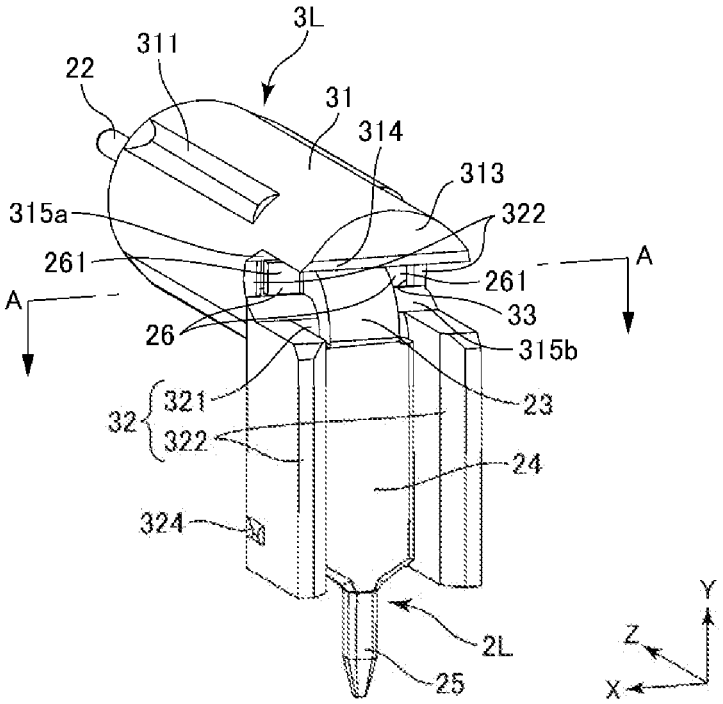
FIG. 16 is a perspective view showing the lower housing and the lower contact pin after the lower contact pin has been press-fitted into the lower housing.
Figure 17:
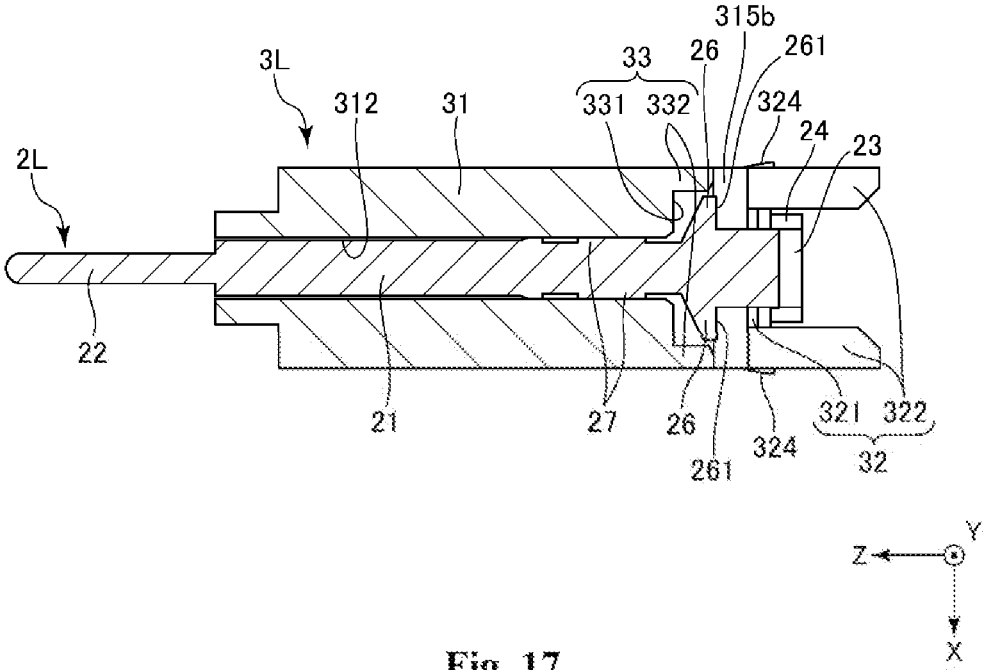
FIG. 17 is an XZ plane cross-sectional view taken along an A-A line shown in FIG. 16.
Figure 18:
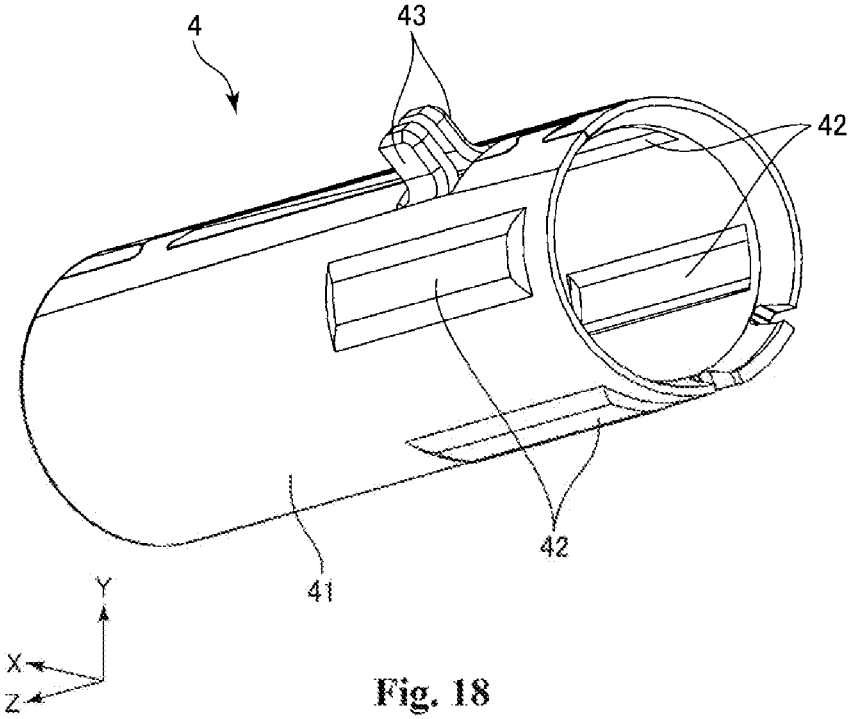
FIG. 18 is a perspective view of an outer contact.
Figure 19:
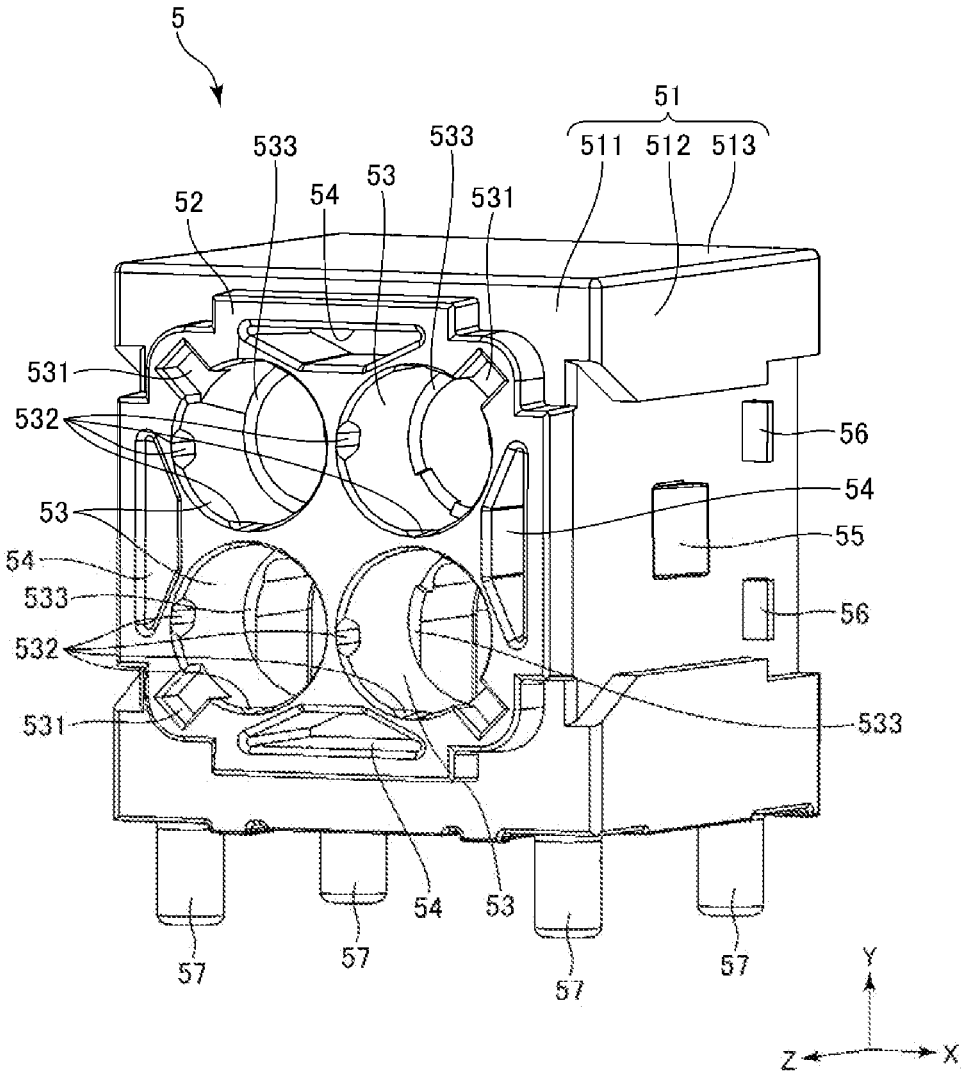
FIG. 19 is a perspective view of a shell.
Figure 20:
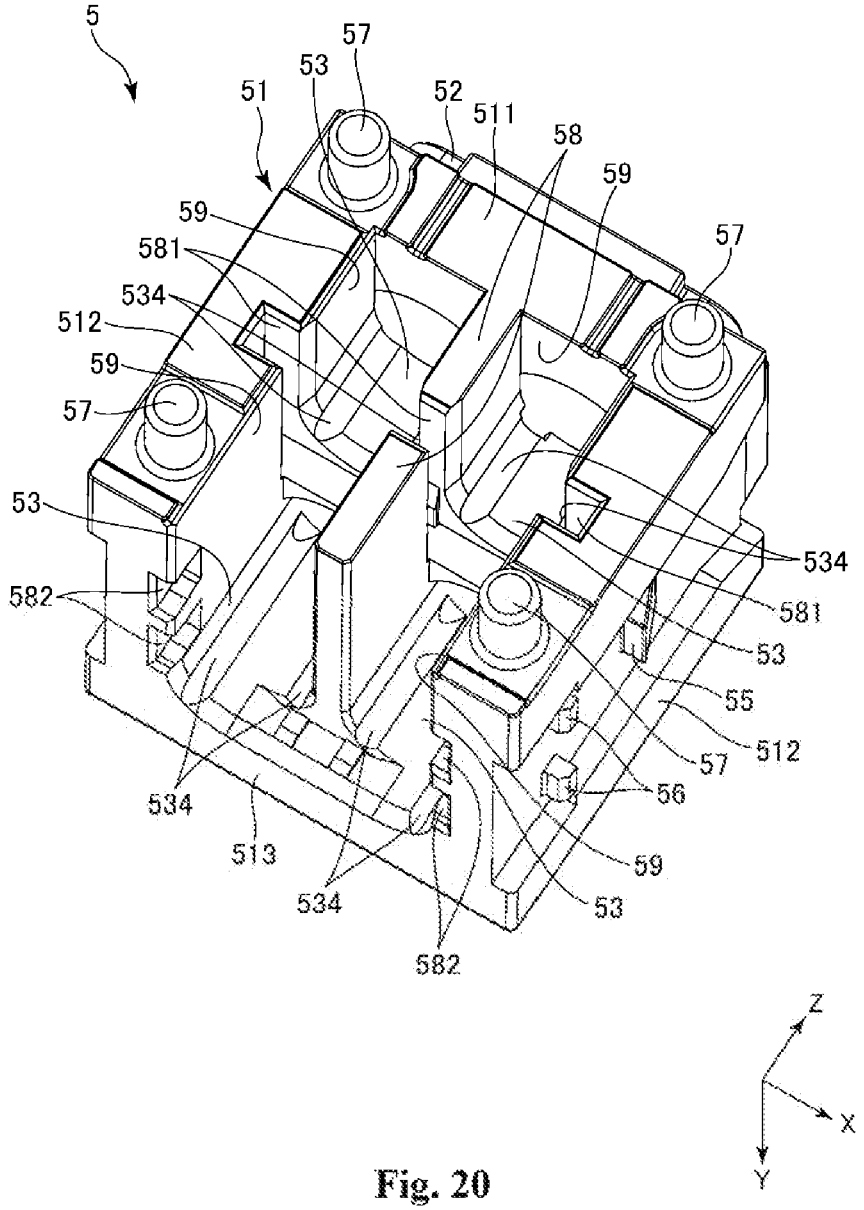
FIG. 20 is another perspective view of the shell viewed from another angle.
Figure 21:
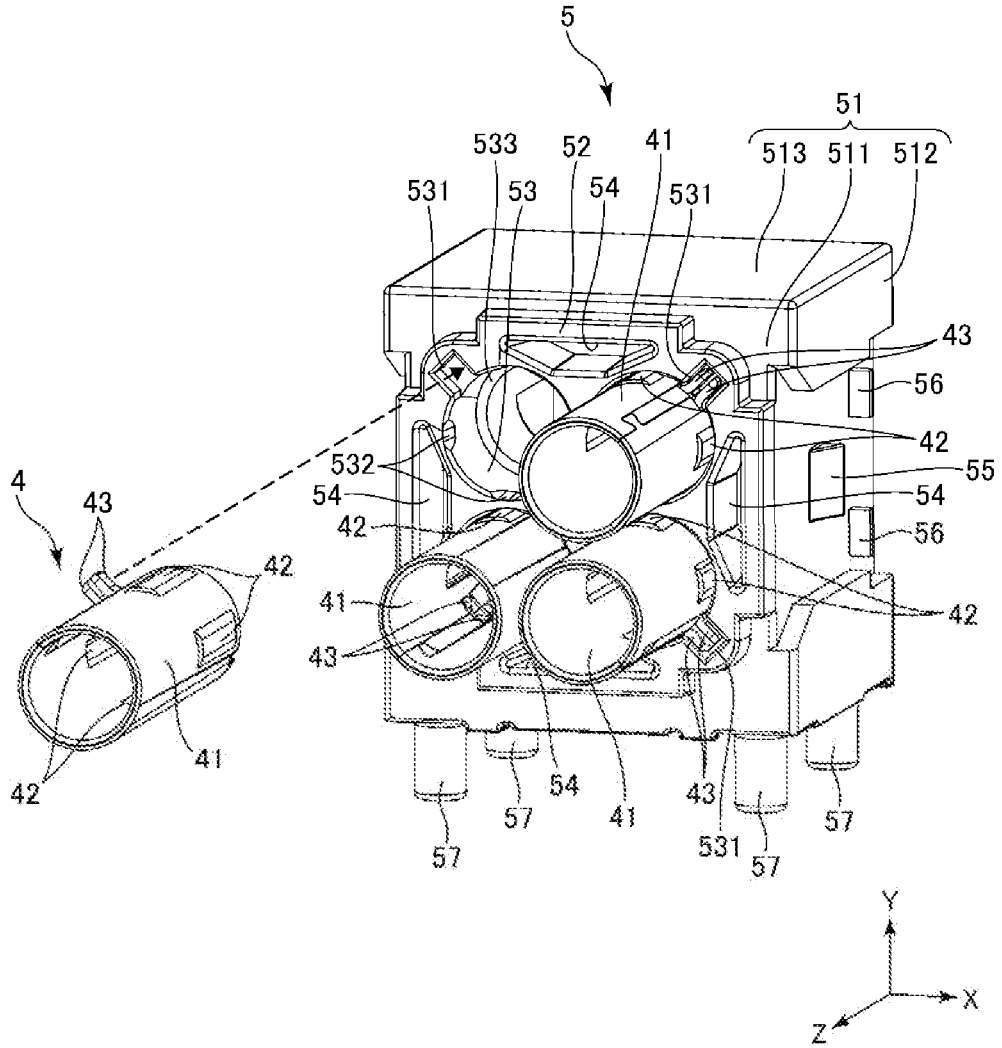
FIG. 21 is a diagram for explaining attachment of the outer contact with respect to the shell.
Figure 22:
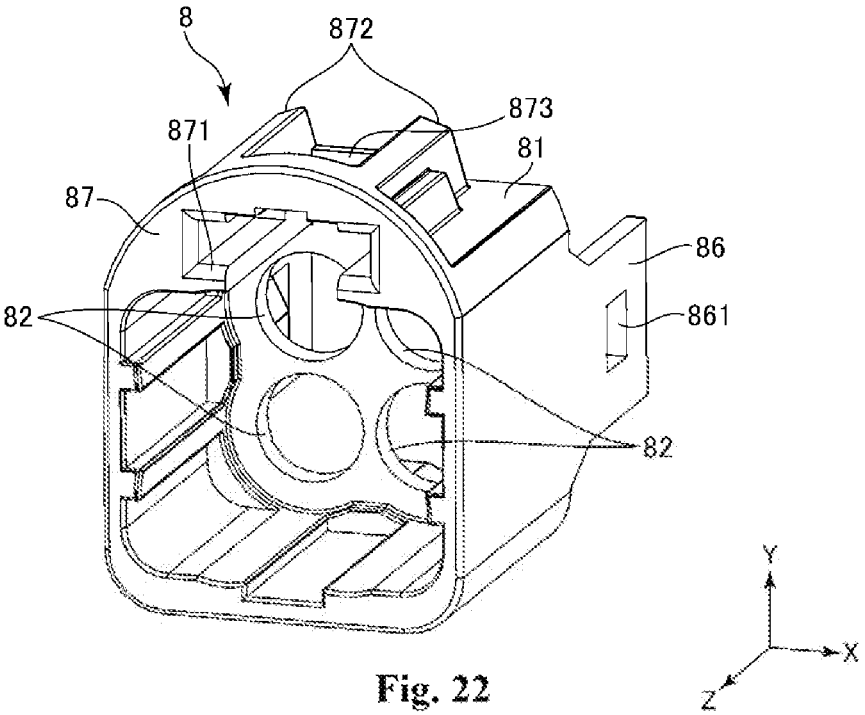
FIG. 22 is a perspective view of a cover.
Figure 23:
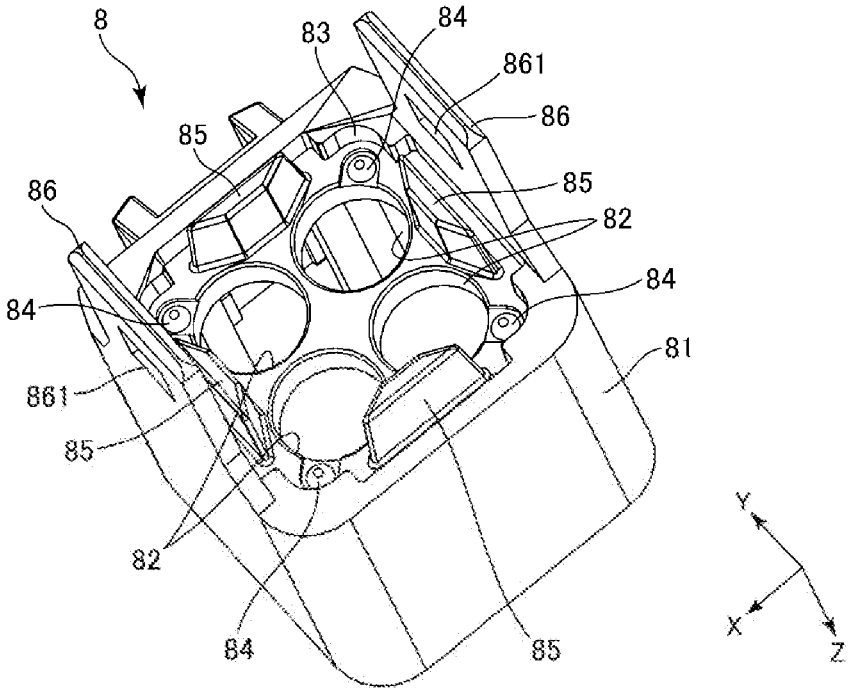
FIG. 23 is another perspective view of the cover viewed from another angle.
Figure 24:
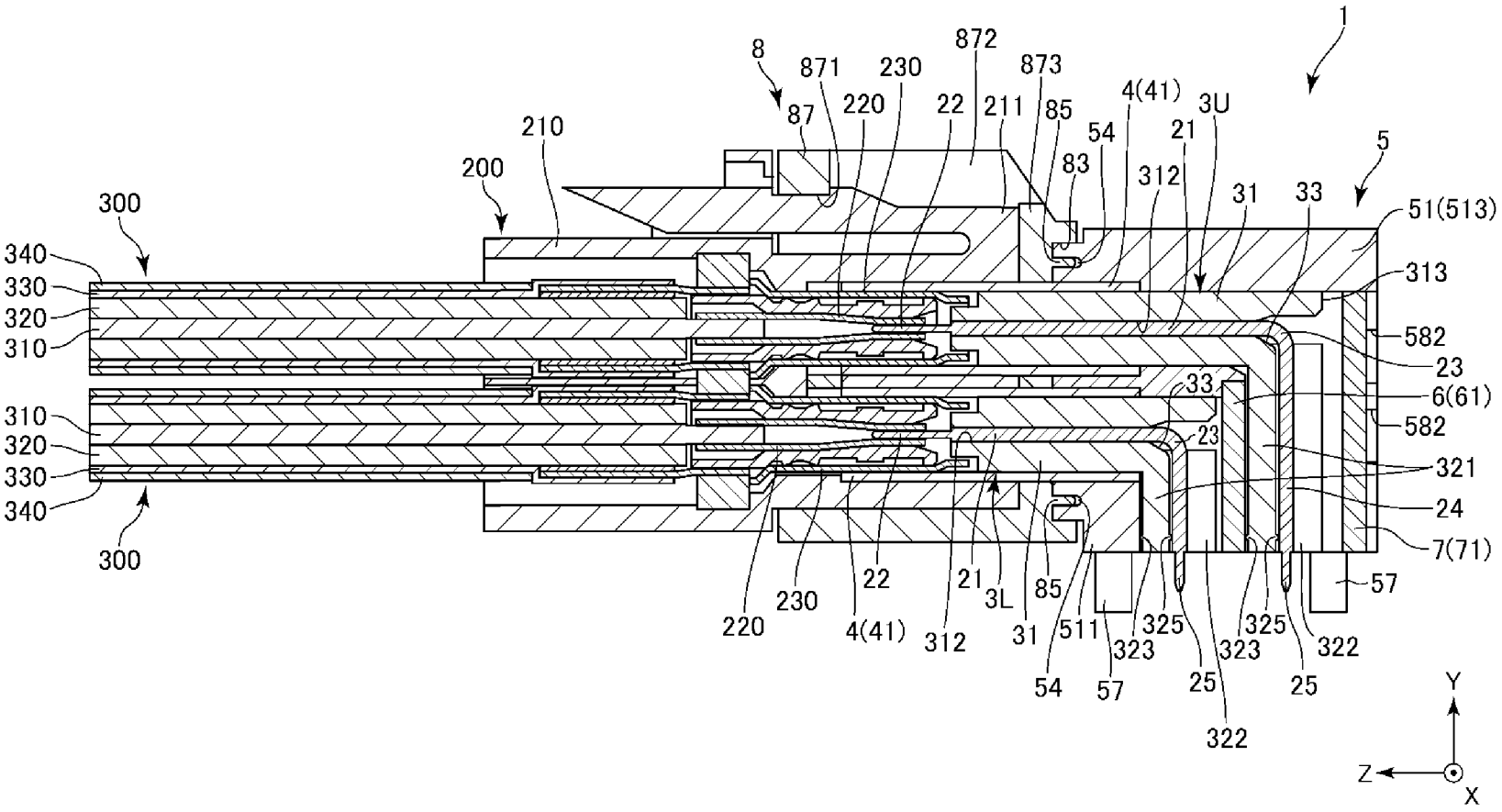
FIG. 24 is a YZ plane cross-sectional view containing the lower contact pin and the upper contact pin in a state that the electrical connector and the mating connector are coupled with each other.

FIG. 3 is a perspective view showing an electrical connector of the present disclosure, a circuit board on which the electrical connector of the present disclosure should be mounted and a mating connector which should be connected with the electrical connector of the present disclosure. FIG. 4 is a perspective view of the electrical connector shown in FIG. 3. FIG. 5 is another perspective view of the electrical connector shown in FIG. 3 viewed from another angle. FIG. 6 is a YZ plane cross-sectional view containing an upper contact pin and a lower contact pin of the electrical connector shown in FIG. 3. FIG. 7 is an exploded perspective view of the electrical connector shown in FIG. 3. FIG. 8 is a perspective view of the lower contact pin. FIG. 9 is a perspective view of the upper contact pin. FIG. 10A is a view showing a modified example of the lower contact pin. FIG. 10B is another view showing another modified example of the lower contact pin. FIG. 11 is a planar view showing a work-in-process of the lower contact pin. FIG. 12 is a perspective view of a lower housing. FIG. 13 is another perspective view of the lower housing viewed from another angle. FIG. 14 is a perspective view for explaining a method of press-fitting the lower contact pin into the lower housing. FIG. 15 is a schematic diagram for explaining the method of press-fitting the lower contact pin into the lower housing. FIG. 16 is a perspective view showing the lower housing and the lower contact pin after the lower contact pin has been press-fitted into the lower housing. FIG. 17 is an XZ plane cross-sectional view taken along an A-A line shown in FIG. 16. FIG. 18 is a perspective view of an outer contact. FIG. 19 is a perspective view of a shell. FIG. 20 is another perspective view of the shell viewed from another angle. FIG. 21 is a diagram for explaining attachment of the outer contact with respect to the shell. FIG. 22 is a perspective view of a cover. FIG. 23 is another perspective view of the cover viewed from another angle. FIG. 24 is a YZ plane cross-sectional view containing the lower contact pin and the upper contact pin in a state that the electrical connector and the mating connector are coupled with each other.

As shown in FIG. 3, an electrical connector 1 of the present disclosure is a receptacle connector which should be mounted on a circuit board 100 provided in an arbitrary device. When a mating connector (a plug connector) 200 attached to one end portions of four coaxial cables 300 is inserted into the electrical connector 1 from the tip side to couple the electrical connector 1 with the mating connector 200, the four coaxial cables 300 and the circuit board 100 are electrically connected to each other through the electrical connector 1 and the mating connector 200.

Each of the coaxial cables 300 has a coaxial structure in which a core wire (a center conductor) 310, an inner insulator layer 320 covering the core wire 310, an outer conductor layer (a braid layer) 330 covering the inner insulator layer 320 and an outer insulator layer 340 covering the outer conductor layer 330 are concentrically arranged. Although this matter is omitted in FIG. 3, other end portions of the coaxial cables 300 are connected to another device differing from the device including the circuit board 100. Thus, when the electrical connector 1 and the mating connector 200 are coupled with each other, it becomes possible to perform a signal communication between the device including the circuit board 100 and the other device through the coaxial cables 300. The device including the circuit board 100 is typically an ECU (Electronic Control Unit) for controlling operations of a vehicle. The other device to which the other end portions of the coaxial cables 300 are connected is typically an in-vehicle device such as a car navigation, a car audio, an in-vehicle camera, an in-vehicle GPS, an in-vehicle TV and an in-vehicle radio. By coupling the electrical connector 1 and the mating connector 200 with each other, it becomes possible to perform a high-speed signal communication between the in-vehicle device and the ECU through the four coaxial cables 300. The electrical connector 1 may be a 1-pin connector for providing a coaxial connection with one coaxial cable 300 or may be a multi-pin connector for providing coaxial connections with a plurality of coaxial cables 300. Hereinafter, the electrical connector 1 will be described with assuming that the electrical connector 1 is a 4-pin connector for providing coaxial connections with the four coaxial cables 300.

As shown in FIGS. 4-7, in particular FIG. 7, the electrical connector 1 includes two lower contact pins 2L and two upper contact pin 2U which should be respectively contacted with corresponding contact pins 220 (see FIG. 24) of the mating connector 200, two lower housings 3L for respectively holding the two lower contact pins 2L, two upper housings 3U for respectively holding the two upper contact pins 2U, four cylindrical outer contacts 4 for respectively covering the two lower housings 3L and the two upper housings 3U, a metallic shell 5 for holding the lower housings 3L, the upper housings 3U and the outer contacts 4, a shield member 6 inserted into the shell 5 for preventing electromagnetic interference between the two lower contact pins 2L and the two upper contact pins 2U, a lid 7 for closing the shell 5 from the base end and a cover 8 attached to a tip end portion of the shell 5.

Each of the lower contact pins 2L and the upper contact pins 2U is an L-shaped member made of a conductive material such as a copper alloy. Each of the lower contact pins 2L and the upper contact pins 2U contacts with the corresponding contact pin 220 of the mating connector 200 to provide an electrical connection between the mating connector 200 and the electrical connector 1 when the electrical connector 1 and the mating connector 200 are coupled with each other. As shown in FIGS. 8 and 9, each of the lower contact pins 2L and the upper contact pins 2U includes a horizontally extending portion 21 linearly extending in the insertion and extraction direction of the mating connector 200 (the Z direction), a contact portion 22 linearly extending from a tip end portion of the horizontally extending portion 21 toward the tip side, a connection portion 23 curved from a base end portion of the horizontally extending portion 21 so as to extend toward the lower side, a downwardly extending portion 24 extending from a lower end portion of the connection portion 23 toward the lower side, a terminal portion 25 protruding from a lower end portion of the downwardly extending portion 24 toward the lower side, a pair of press-fitting shoulders 26 respectively extending from both side portions (both side surfaces in the X direction) of the base end portion of the horizontally extending portion 21 in the width direction of the lower contact pin 2L or the upper contact pin 2U (the X direction or the outer side) perpendicular to the insertion and extraction direction of the mating connector 200 (the Z direction) and a pair of cut marks 27 respectively protruding in the width direction of the lower contact pin 2L or the upper contact pin 2U from both side portions of a portion located more to the tip side than a portion where the pair of press-fitting shoulders 26 of the horizontally extending portion 21 are formed. In this regard, since the lower contact pin 2L has the same configuration as the configuration of the upper contact pin 2U except that lengths of the horizontally extending portion 21 and the downwardly extending portion 24 are different, the configuration of the lower contact pin 2L will be described with reference to FIG. 8 in the following description as a representative. Although each of the lower contact pins 2L and the upper contact pins 2U includes the pair of press-fitting shoulders 26 in the illustrated aspect, the number of the press-fitting shoulders 26 is not limited to two. The scope of the disclosure also involves an aspect in which each of the lower contact pins 2L and the upper contact pins 2U includes at least one press-fitting shoulder 26.

The horizontally extending portion 21 is a plate-like portion linearly extending in the insertion and extraction direction of the mating connector 200 (the Z direction). When the lower contact pin 2L is press-fitted into an insertion hole 312 (see FIG. 7) formed in a cylindrical portion 31 of the lower housing 3L, the horizontally extending portion 21 is located in the cylindrical portion 31 of the lower housing 3L. As shown in FIG. 6, a portion other than the base end portion of the horizontally extending portion 21 is held in the insertion hole 312 formed in the cylindrical portion 31 of the lower housing 3L, and thereby the lower contact pin 2L is held by the lower housing 3L.

The contact portion 22 is a columnar portion linearly extending from the tip end portion of the horizontally extending portion 21 toward the tip side. Further, the contact portion 22 protrudes from the cylindrical portion 31 of the lower housing 3L toward the tip side so as to be exposed to the outside in a state that the lower contact pin 2L is held by the lower housing 3L. When the electrical connector 1 and the mating connector 200 are coupled with each other, the contact portion 22 contacts with the corresponding contact pin 220 of the mating connector 200 to provide the electrical connection between the mating connector 200 and the electrical connector 1.

The connection portion 23 is a plate-like portion for connecting the horizontally extending portion 21 and the downwardly extending portion 24. The connection portion 23 is curved from the base end portion of the horizontally extending portion 21 toward the lower side. The downwardly extending portion 24 is a plate-like portion linearly extending from the lower end portion of the connection portion 23 toward the lower side. The downwardly extending portion 24 is located in a downwardly extending portion 32 (see FIG. 7) of the lower housing 3L in the state that the lower contact pin 2L is held by the lower housing 3L. The terminal portion 25 is a conical portion formed so as to protrude from the lower end portion of the downwardly extending portion 24 toward the lower side. The terminal portion 25 extends from the lower contact pin 2L toward the lower side so as to be exposed to the outside in the state that the lower contact pin 2L is held by the lower housing 3L. The terminal portion 25 should be connected to the corresponding terminal 120 (see FIG. 3) of the circuit board 100.

The pair of press-fitting shoulders 26 are plate-like portions respectively extending in the width direction of the lower contact pin 2L (the X direction) from the both side portions (the both side surfaces in the X direction) of the base end portion of the horizontally extending portion 21. A thickness (a length in the Y direction) of each of the pair of press-fitting shoulders 26 is the same as a thickness of the horizontally extending portion 21. Thus, an upper surface of the horizontally extending portion 21 and upper surfaces of the pair of press-fitting shoulders 26 are located on one plane. Similarly, a lower surface of the horizontally extending portion 21 and lower surfaces of the pair of press-fitting shoulders 26 are also located on another one plane. The thickness of the horizontally extending portion 21 and the thickness of each of the pair of press-fitting shoulders 26 may be appropriately set to different values according to a shape, a state and the like of the lower housing 3L into which the lower contact pin 2L is press-fitted.

Each of the pair of press-fitting shoulders 26 has a tapered shape whose width (length in the X direction) gradually decreases from the base side (the −Z direction side) toward the tip side (the +Z direction side). Further, each of base end surfaces (−Z direction end surfaces) of the pair of press-fitting shoulders 26 is a flat surface perpendicular to the insertion and extraction direction of the mating connector 200 (the Z direction). The lower contact pin 2L is press-fitted into the insertion hole 312 of the lower housing 3L by pressing the base end surfaces of the pair of press-fitting shoulders 26 with a press-fitting tool 400 (see FIG. 15) as described later. Although each of the pair of press-fitting shoulders 26 has the tapered shape whose width gradually decreases (monotonically decreases) from the base side toward the tip side in the illustrated aspect, the present disclosure is not limited thereto. FIGS. 10A and 10B illustrate modified examples of the lower contact pin 2L. In the modified example of the lower contact pin 2L shown in FIG. 10A, the width of each of the pair of press-fitting shoulders 26 discontinuously decreases from the base side (the −Z direction side) toward the tip side (the +Z direction side) and each of the pair of press-fitting shoulders 26 has a stepped shape in the XZ planar view thereof. In the other modified example of the lower contact pin 2L shown in FIG. 10B, the width of each of the pair of press-fitting shoulders 26 non-monotonically decreases from the base side (the −Z direction side) toward the tip side (the +Z direction side) and each of the pair of press-fitting shoulders 26 has an arc shape in the XZ planar view thereof. The scope of the present disclosure also involves aspects respectively using the modified examples of the lower contact pin 2L shown in FIG. 10A and FIG. 10B.

The pair of cut marks 27 are portions respectively protruding in the width direction of the lower contact pin 2L from the both side surfaces of the portion located more to the tip side than the portion where the pair of press-fitting shoulders 26 of the horizontally extending portion 21 are formed. The pair of cut marks 27 are remaining portions of a carrier 28 (see FIG. 11) remaining at the horizontally extending portion 21 of the lower contact pin 2L when the lower contact pin 2L is cut out from the carrier 28 for manufacturing the lower contact pin 2L. Hereinafter, a manufacturing process of the lower contact pin 2L will be described in detail with reference to FIG. 11.

In the manufacturing process of the lower contact pin 2L, a sheet of metal plate is first punched into a predetermined shape to obtain a work-in-process shown in FIG. 11. When the lower contact pin 2L is in a stage of work-in-process, the connection portion 23 of the lower contact pin 2L is not curved and the carrier 28 is connected to the both side surfaces of the portion located more to the tip side than the portion where the pair of press-fitting shoulders 26 of the horizontally extending portion 21 of the lower contact pin 2L are formed. In this state, a cutting process is subjected to portions illustrated by the dotted lines in FIG. 11 to cut out the lower contact pin 2L from the carrier 28. The remaining portions of the carrier 28 remaining at the horizontally extending portion 21 after the cutting process are completed are the pair of cut marks 27.

Next, a curving process is performed for curving the connection portion 23 of the lower contact pin 2L toward the lower side (the −Y direction) to obtain the lower contact pin 2L shown in FIG. 8. In this regard, the connection portion 23 is curved in the curving process so that an angle formed by the horizontally extending portion 21 and the downwardly extending portion 24 of the lower contact pin 2L becomes slightly larger than 90 degrees. More specifically, the connection portion 23 is curved so that the angle formed by the horizontally extending portion 21 and the downwardly extending portion 24 of the lower contact pin 2L falls within the range of about 91 to 92 degrees. By making the angle formed by the horizontally extending portion 21 and the downwardly extending portion 24 slightly larger than 90 degrees at the time of manufacturing the lower contact pin 2L, it becomes possible to adjust the angle formed by the horizontally extending portion 21 and the downwardly extending portion 24 of the lower contact pin 2L at the time of press-fitting the lower contact pin 2L into the insertion hole 312 of the lower housing 3L. Specifically, it becomes possible to adjust the angle formed by the horizontally extending portion 21 and the downwardly extending portion 24 of the lower contact pin 2L by pressing the downwardly extending portion 24 of the lower contact pin 2L onto a rear rib 325 (see FIG. 13) formed inside the downwardly extending portion 32 of the lower housing 3L at the time of press-fitting the lower contact pin 2L into the insertion hole 312 of the lower housing 3L. Although the curving process is subjected to the lower contact pin 2L after the lower contact pin 2L is cut out from the carrier 28 in the above description, the present disclosure is not limited thereto. The lower contact pin 2L may be cut out from the carrier 28 after the curving process is subjected to the lower contact pin 2L. The manufacturing process of the lower contact pin 2L has been described. Since a manufacturing method of the upper contact pin 2U is the same as the manufacturing process of the lower contact pin 2L, description for the manufacturing process of the upper contact pin 2U will be omitted.

The above-mentioned lower contact pin 2L is press-fitted into the insertion hole 312 of the lower housing 3L and held by the lower housing 3L. Similarly, the upper contact pin 2U is press-fitted into the insertion hole 312 of the upper housing 3U and held by the upper housing 3U. Each of the lower housing 3L and the upper housing 3U is made of an insulating material having elasticity such as a resin material. Each of the lower housing 3L and the upper housing 3U includes the cylindrical portion 31 extending in the insertion and extraction direction of the mating connector 200 and the downwardly extending portion 32 extending from a base end portion of the cylindrical portion 31 toward the lower side as shown in FIG. 7. The lower housing 3L has the same configuration as the configuration of the upper housing 3U except those lengths of the cylindrical portion 31 and the downwardly extending portion 32 are different. Thus, the configuration of the lower housing 3L will be described in detail with reference to FIGS. 12 and 13 and description for the configuration of the upper housing 3U will be omitted.

The cylindrical portion 31 is a cylindrical portion linearly extending in the insertion and extraction direction of the mating connector 200 (the Z direction) as shown in FIGS. 12 and 13. The cylindrical portion 31 includes four ribs 311 formed at equal angular intervals on an outer peripheral surface of the cylindrical portion 31, the insertion hole 312 passing through the cylindrical portion 31 in the insertion and extraction direction of the mating connector 200, a ceiling portion 313 extending from an upper portion of the base end surface of the cylindrical portion 31 toward the base side and a concave portion 33 formed on the base end surface of the cylindrical portion 31 so as to open toward the base side.

The four ribs 311 are protruding portions formed at the equal angular intervals on the outer peripheral surface of the cylindrical portion 31 so as to linearly extend in the insertion and extraction direction of the mating connector 200 (the Z direction). When the lower housing 3L is press-fitted into the outer contact 4, the four ribs 311 are elastically deformed and contact with an inner peripheral surface of the outer contact 4. With this structure, it is possible to ensure concentricity between the lower housing 3L and the outer contact 4 as well as prevent the lower housing 3L from being removed from the outer contact 4. Further, it is possible to improve the signal transmission characteristics of the electrical connector 1 since the concentricity between the lower housing 3L and the outer contact 4 is ensured.

Although the four ribs 311 are formed at the equal angular intervals on the outer peripheral surface of the cylindrical portion 31 in the illustrated aspect, the number of ribs 311 formed at the equal angular intervals on the outer peripheral surface of the cylindrical portion 31 is not limited thereto. Three, five or more ribs 311 may be formed at the equal angular intervals on the outer peripheral surface of the cylindrical portion 31. By forming at least three ribs 311 at the equal angular intervals on the outer peripheral surface of the cylindrical portion 31, it is possible to provide the above-mentioned effect of ensuring the concentricity between the lower housing 3L and the outer contact 4 and the above-mentioned effect of preventing the lower housing 3L from being removed from the outer contact 4.

The insertion hole 312 formed at a center of the cylindrical portion 31 so as to pass through the cylindrical portion 31 in the insertion and extraction direction of the mating connector 200. The lower contact pin 2L is press-fitted into the insertion hole 312 as described above. The insertion hole 312 has a shape corresponding to the shape of the horizontally extending portion 21 of the lower contact pin 2L and a portion of the lower contact pin 2L other than the base end portion of the horizontally extending portion 21 is held in the insertion hole 312.

The ceiling portion 313 is a portion extending from the upper portion of the base end surface of the cylindrical portion 31 toward the base side so as to cover the connection portion 23 of the lower contact pin 2L and the downwardly extending portion 32 of the lower contact pin 2L from the upper side through a gap therebetween. The ceiling portion 313 protrudes from the base end surface of the cylindrical portion 31 toward the base side so that an upper surface of the ceiling portion 313 is continuous with the outer peripheral surface of the cylindrical portion 31. A lower surface of the ceiling portion 313 is a flat surface perpendicular to the Y-axis. Further, a corner portion formed by a base end surface and a bottom surface of the ceiling portion 313 is chamfered so as to form a slope 314 between the base end surface and the bottom surface of the ceiling portion 313.

The concave portion 33 has a function of containing the pair of press-fitting shoulders 26 of the lower contact pin 2L therein when the lower contact pin 2L is held by the lower housing 3L. As shown in FIG. 13, the concave portion 33 is formed on the base end surface of the cylindrical portion 31 so as to open toward the base side and communicates with the insertion hole 312. The concave portion 33 is defined by a bottom surface 331 directed toward the base side and wall portions 332 extending from the bottom surface 331 toward the base side. The bottom surface 331 is a flat surface perpendicular to the insertion and extraction direction of the mating connector 200 (the Z direction). The insertion hole 312 is formed in a width-direction (X direction) central portion of the bottom surface 331. The wall portions 332 are portions respectively extending from four marginal portions of the bottom surface 331 toward the base side so as to surround the bottom surface 331. A slope 315*a* is formed between the upper wall portion 332 and the lower surface of the ceiling portion 313 so as to incline from the base side toward the tip side. On the other hand, another slope 315*b* is formed between the lower wall portion 332 and the downwardly extending portion 32 so as to incline from the base side toward the tip side. The slopes 315*a*, 315*b* serve as guide portions for guiding the lower contact pin 2L when the lower contact pin 2L is press-fitted into the insertion hole 312.

The downwardly extending portion 32 is a portion for containing the downwardly extending portion 24 of the lower contact pin 2L therein when the lower contact pin 2L is held by the lower housing 3L. The downwardly extending portion 32 includes a front plate 321 extending from a lower portion of the base end surface of the cylindrical portion 31 toward the lower side and a pair of wall portions 322 extending from both width-direction (X direction) edges of the front plate 321 toward the base side.

The front plate 321 is a plate-like portion vertically extending from the lower portion of the base end surface of the cylindrical portion 31 toward the lower side. As shown in FIG. 12, a front rib 323 is formed on a tip end surface of the front plate 321 so as to linearly extend in the width direction of the front plate 321 (the X direction). The front rib 323 is a portion which contacts with an inner surface of a body portion 51 of the shell 5 (see FIG. 7) when the cylindrical portion 31 of the lower housing 3L is inserted into one of insertion holes 53 of the shell 5 from the base side for positioning the lower housing 3L and correcting an angle formed by the front plate 321 and the base end surface of the cylindrical portion 31.

When the lower housing 3L is obtained through a molding process using the insulating material having the elasticity such as the resin material, there is a tendency that the angle formed by the front plate 321 and the cylindrical portion 31 is changed from 90 degrees by shrinkage of the insulating material after the molding process. Deformation of such a molded product caused by the shrinkage of the insulating material after the molding process is called "molding deformation". In the present disclosure, the front rib 323 formed on the tip end surface of the front plate 321 contacts with the inner surface of the body portion 51 of the shell 5 when the cylindrical portion 31 of the lower housing 3L is inserted into the insertion hole 53 of the shell 5. Thus, even if the angle formed by the front plate 321 and the cylindrical portion 31 is changed from 90 degrees by the molding deformation, the angle formed by the front plate 321 and the cylindrical portion 31 can be corrected because the front rib 323 contacts with the inner surface of the body portion 51 of the shell 5. By correcting the angle formed by the front plate 321 and the cylindrical portion 31 to 90 degrees as described above, it is possible to make a positional relationship between the lower housing 3L and the lower contact pin 2L contained in the lower housing 3L (i.e., a distance and a space between the lower contact pin 2L and the insulating material) constant, and thereby it is possible to stabilize the signal transmission characteristics of the electrical connector 1. Further, it is possible to prevent backlash of the lower housing 3L in the body portion 51 of the shell 5 because the front rib 323 contacts with the inner surface of the body portion 51 of the shell 5.

On the other hand, a rear rib 325 is formed on a base end surface of the front plate 321 so as to linearly extend in the width direction of the front plate 321 (the X direction) as shown in FIG. 13. The rear rib 325 is formed at a position facing the front rib 323 through the front plate 321. The rear rib 325 is provided for adjusting the angle formed by the horizontally extending portion 21 and the downwardly extending portion 24 of the lower contact pin 2L. As described above, the lower contact pin 2L is formed so that the angle formed by the horizontally extending portion 21 and the downwardly extending portion 24 is slightly larger than 90 degrees. Thus, when the lower contact pin 2L is press-fitted into the insertion hole 312 of the lower housing 3L, the angle formed by the horizontally extending portion 21 and the downwardly extending portion 24 of the lower contact pin 2L can be adjusted by pressing the downwardly extending portion 24 of the lower contact pin 2L onto the rear rib 325 formed inside the downwardly extending portion 32 of the lower housing 3L. As a result, the angle formed by the front plate 321 and the base end surface of the cylindrical portion 31 of the lower housing 3L accurately matches the angle formed by the horizontally extending portion 21 and the downwardly extending portion 24 of the lower contact pin 2L.

The pair of wall portions 322 are plate-like portions respectively extending from the both width-direction edges of the front plate 321 toward the base side. The base end surface of the front plate 321 and inner surfaces of the pair of wall portions 322 define an internal space of the downwardly extending portion 32. When the lower contact pin 2L is held by the lower housing 3L, the downwardly extending portion 24 of the lower contact pin 2L is located in the internal space of the downwardly extending portion 32 of the lower housing 3L. Lateral ribs 324 are respectively formed on outer surfaces of the pair of wall portions 322. The lateral ribs 324 linearly extend in the insertion and extraction direction of the mating connector 200 (the Z direction) on the outer surfaces of the pair of wall portions 322. The lateral ribs 324 are provided for positioning the lower housing 3L when the cylindrical portion 31 of the lower housing 3L is inserted into the insertion hole 53 of the shell 5. In addition, since the lateral ribs 324 contact with the inner surface of the body portion 51 of the shell 5 when the cylindrical portion 31 of the lower housing 3L is inserted into the insertion hole 53 of the shell 5, it is possible to prevent backlash of the lower housing 3L in the body portion 51 of the shell 5.

As shown in FIG. 14, the lower contact pin 2L is press-fitted into the lower housing 3L. Hereinafter, a process for press-fitting the lower contact pin 2L into the lower housing 3L will be described in detail with reference to FIGS. 14, 15. In this regard, since a process of press-fitting the upper contact pin 2U into the upper housing 3U is the same as the process of press-fitting the lower contact pin 2L into the lower housing 3L, description for the process of press-fitting the contact pin 2U into the upper housing 3U is omitted.

The lower contact pin 2L is press-fitted into the lower housing 3L from the base side as shown in FIG. 14. When the lower contact pin 2L is press-fitted into the lower housing 3L, the press-fitting tool 400 for press-fitting the lower contact pin 2L into the lower housing 3L is used as shown in FIG. 15. The press-fitting tool 400 has a pair of protruding portions 410 for respectively pressing base end surfaces of the pair of press-fitting shoulders 26 of the lower contact pin 2L and a concave portion 420 for receiving the connection portion 23 and the downwardly extending portion 24 of the lower contact pin 2L. Each of the pair of protruding portions 410 is block-like portion whose tip end surface is a flat surface perpendicular to the insertion and extraction direction of the mating connector 200 (the Z direction). Further, a thickness (a length in the Y direction) of each of the pair of protruding portions 410 is substantially equal to a separation distance between the lower surface of the ceiling portion 313 and the upper surfaces of the pair of wall portions 322 of the downwardly extending portion 32 of the lower housing 3L. Thus, the pair of protruding portions 410 can be inserted into a space between the lower surface of the ceiling portion 313 and the upper surfaces of the pair of wall portions 322 of the downwardly extending portion 32 of the lower housing 3L. Further, in a state that the connection portion 23 and the downwardly extending portion 24 of the lower contact pin 2L are located in the concave portion 420 and the lower contact pin 2L is being press-fitted into the lower housing 3L, outer portions of the pair of protruding portions 410 outwardly protrude in the width direction from the cylindrical portion 31 of the lower housing 3L as shown in FIG. 15.

First, the contact portion 22 of the lower contact pin 2L is inserted into the insertion hole 312 of the lower housing 3L from the base side. Next, the pair of protruding portions 410 of the press-fitting tool 400 are respectively brought into contact with the base end surfaces of the pair of press-fitting shoulders 26 of the lower contact pin 2L. Next, the press-fitting tool 400 is pressed toward the tip side for press-fitting the lower contact pin 2L into the insertion hole 312 of the lower housing 3L. After that, the downwardly extending portion 24 of the lower contact pin 2L contacts with the rear rib 325 of the lower housing 3L and thus the lower contact pin 2L is positioned in the lower housing 3L. Next, the pressing against the lower contact pin 2L with the press-fitting tool 400 is released and the press-fitting of the lower contact pin 2L into the lower housing 3L is completed.

In particular, the base end portions 261 of the pair of press-fitting shoulders 26 of the lower contact pin 2L protrude from the concave portion 33 formed on the base end surface of the cylindrical portion 31 of the lower housing 3L toward the base side and are exposed toward the base side in the state that the press-fitting of the lower contact pin 2L to the lower housing 3L is completed as shown in FIG. 15. With this configuration, it is possible to keep pressing the pair of press-fitting shoulders 26 of the lower contact pin 2L by using the pair of protruding portions 410 of the press-fitting tool 400 until the downwardly extending portion 24 of the lower contact pin 2L contacts with the rear rib 325 of the lower housing 3L and the lower contact pin 2L is positioned in the lower housing 3L.

As described above, the lower housing 3L of the present disclosure is configured so that the space through which the pair of protruding portions 410 of the press-fitting tool 400 can be inserted is formed between the lower surface of the ceiling portion 313 and the upper surfaces of the pair of wall portions 322 of the downwardly extending portion 32 of the lower housing 3L. Further, any portions which block the insertion of the pair of protruding portions 410 of the press-fitting tool 400 do not exist between the lower surface of the ceiling portion 313 and the upper surfaces of the pair of wall portions 322 of the downwardly extending portion 32 of the lower housing 3L. Therefore, it is possible to press entire areas of the base end surfaces of the pair of press-fitting shoulders 26 of the lower contact pin 2L with the press-fitting tool 400 including the pair of protruding portions 410 whose tip end surfaces are the flat surfaces as shown in FIG. 15.

Figure 2:
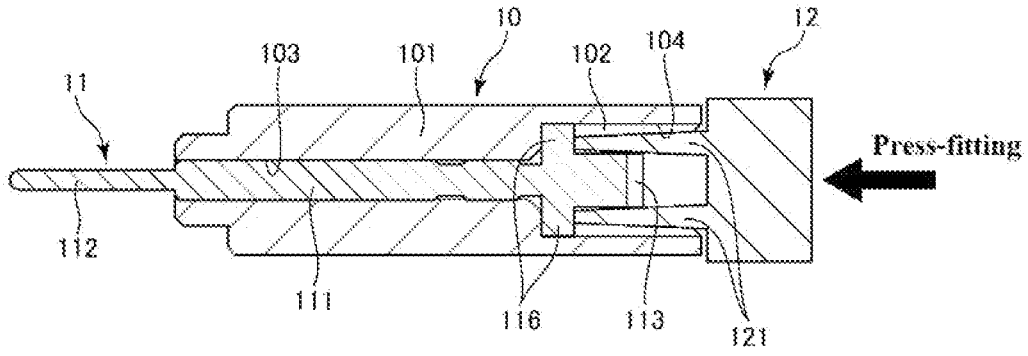
Prior art Fig. 2
FIG. 2 is a schematic diagram for explaining a method of press-fitting the contact pin into an insertion hole of the housing shown in FIG. 1.

On the other hand, in the housing 10 typically used in the conventional electrical connector described with reference to FIG. 2, the press-fitting window 104 is formed on the base end portion of the cylindrical portion 101 of the housing 10. However, if the press-fitting tool 400 is used for press-fitting the contact pin 11 of the conventional electrical connector into the housing 10, the width-direction wall portions among the four wall portions defining the press-fitting window 104 contact with the pair of protruding portions 410 of the press-fitting tool 400. Thus, it is impossible to press-fit the contact pin 11 into the housing 10 by using the press-fitting tool 400. For this reason, it is necessary to use the press-fitting tool 12 having the pair of rod-like protrusions 121 protruding toward the tip side for press-fitting the contact pin 11 of the conventional electrical connector into the housing 10 as described with reference to FIG. 2.

In the electrical connector 1 of the present disclosure, the space through which the pair of protruding portions 410 of the press-fitting tool 400 can be inserted is formed between the lower surface of the ceiling portion 313 and the upper surfaces of the pair of wall portions 322 of the downwardly extending portion 32 of the lower housing 3L. Thus, it is unnecessary to press the base end surfaces of the pair of press-fitting shoulders 26 of the lower contact pin 2L in a pinpoint manner by using the press-fitting tool 12 including the pair of rod-like protrusions 121 protruding toward the tip side as described with reference to FIG. 2.

If the entire areas of the base end surfaces of the pair of press-fitting shoulders 26 of the lower contact pin 2L are pressed by the pair of protruding portions 410 of the press-fitting tool 400, the press-fitting of the lower contact pin 2L into the lower housing 3L becomes more stable than the case where the base end surfaces of the pair of press-fitting shoulders 26 of the lower contact pin 2L are pressed by the pair of rod-like protrusions 121 of the press-fitting tool 12 in the pinpoint manner. Thus, by performing the press-fitting process of the lower contact pin 2L into the lower housing 3L with the press-fitting tool 400 including the pair of protruding portions 410 whose tip end surfaces are the flat surfaces in the manufacturing process of the electrical connector 1 of the present disclosure, it is possible to quickly and stably perform the press-fitting process of the lower contact pin 2L into the lower housing 3L. As a result, it is possible to improve the productivity of the electrical connector 1.

FIG. 16 shows the lower housing 3L and the lower contact pin 2L after the lower contact pin 2L is press-fitted into the lower housing 3L. FIG. 17 shows a cross-sectional view taken along an A-A line in FIG. 16 passing through the horizontally extending portion 21 of the lower contact pin 2L. As shown in FIG. 16, the downwardly extending portion 24 of the lower contact pin 2L is located in the internal space of the downwardly extending portion 32 of the lower housing 3L. Further, as shown in FIG. 17, the portion other than the base end portion of the horizontally extending portion 21 of the lower contact pin 2L is located in the insertion hole 312 of the lower housing 3L. Further, the pair of press-fitting shoulders 26 of the lower contact pin 2L are located in the concave portion 33 of the lower housing 3L.

As shown in FIGS. 16 and 17, the base end portions 261 of the pair of press-fitting shoulders 26 of the lower contact pins 2L protrude more to the base side than the wall portions 332 of the concave portion 33 of the lower housing 3L. Thus, the base end portions 261 of the pair of press-fitting shoulders 26 of the lower contact pin 2L are exposed from the concave portion 33 of the lower housing 3L toward the base side.

The pair of press-fitting shoulders 26 of the lower contact pin 2L face the bottom surface 331 of the concave portion 33 of the lower housing 3L through a gap therebetween. Thus, an air layer exists between the pair of press-fitting shoulders 26 of the lower contact pin 2L and the bottom surface 331 of the concave portion 33 of the lower housing 3L. As is well known, a dielectric constant of air is 1.0 and lower than a dielectric constant of the conductive material constituting the lower contact pin 2L. Thus, by providing the air layer between the pair of press-fitting shoulders 26 of the lower contact pin 2L and the bottom surface 331 of the concave portion 33 of the lower housing 3L, it is possible to suppress a decrease of an impedance of the portion where the pair of press-fitting shoulders 26 of the lower contact pin 2L are formed.

In particular, each of the pair of press-fitting shoulders 26 of the lower contact pin 2L has the tapered shape whose width gradually decreases from the base side toward the tip side. Thus, a separation distance between a tip end surface (a front surface) of each of the pair of press-fitting shoulders 26 of the lower contact pin 2L and the bottom surface 331 of the concave portion 33 of the lower housing 3L gradually increases from the tip side toward the base side as shown in FIG. 17. Therefore, a thickness of the air layer between the pair of press-fitting shoulders 26 of the lower contact pin 2L and the bottom surface 331 of the concave portion 33 of the lower housing 3L gradually increases from the tip side toward the base side. With this configuration, it is possible to more effectively suppress the decrease of the impedance of the portion where the pair of press-fitting shoulders 26 of the lower contact pin 2L are formed.

Although the relationship between the lower contact pin 2L and the lower housing 3L and the effect of suppressing the decrease of the impedance caused by the shapes of the pair of press-fitting shoulders 26 of the lower contact pin 2L have been described in detail with reference to FIGS. 16 and 17, this description can be also applied to the upper contact pin 2U and the upper housing 3U. Namely, a relationship between the upper contact pin 2U and the upper housing 3U the effect of suppressing the decrease of the impedance caused by the shapes of the pair of press-fitting shoulders 26 of the upper contact pin 2U are the same as the relationship between the lower contact pin 2L and the lower housing 3L and the effect of suppressing the decrease of the impedance caused by the shapes of the pair of press-fitting shoulders 26 of the lower contact pin 2L.

Referring back to FIG. 7, the four outer contacts 4 serve as external conductors respectively covering the cylindrical portions 31 of the two lower housings 3L and the two upper housings 3U from the outside. When the mating connector 200 is coupled with the electrical connector 1, the four outer contacts 4 respectively contact with corresponding outer contacts 230 (see FIG. 24) of the mating connector 200 to equalize a ground potential of the electrical connector 1 and a ground potential of the mating connector 200. Since all of the four outer contacts 4 have the same configuration except that attachment angles with respect to the shell 5 are different from each other, one outer contact 4 will be described in detail as a representative.

As shown in FIG. 18, the outer contact 4 is a cylindrical member made of a metallic material. The outer contact 4 includes a cylindrical body portion 41, four ribs 42 protruding from an outer peripheral surface of the body portion 41 toward the outside and a pair of positioning protrusions 43 protruding from the outer peripheral surface of the body portion 41 toward the outside.

The body portion 41 is a cylindrical portion linearly extending in the insertion and extraction direction of the mating connector 200 (the Z direction). The four ribs 42 are formed for preventing the outer contact 4 from being removed from the insertion hole 53 of the shell 5 due to a weight of the outer contact 4 and ensuring a concentricity between the outer contact 4 and the insertion hole 53 of the shell 5. The four ribs 42 are formed at equal angular intervals on an outer peripheral surface of a base side portion of the body portion 41 so as to linearly extend in the insertion and extraction direction of the mating connector 200. Each of the four ribs 42 can be elastically deformed toward the inner side. Thus, when the outer contact 4 is press-fitted into the insertion hole 53 of the shell 5, the four ribs 42 are elastically deformed toward the inner side. Further, after the press-fitting of the outer contact 4 into the insertion hole 53 of the shell 5 is completed, the four ribs 42 abut against an inner surface of the insertion hole 53 of the shell 5, and thereby the outer contact 4 is fixed in the insertion hole 53 of the shell 5. As a result, it is possible to prevent the outer contact 4 from being removed from the insertion hole 53 of the shell 5 due to the weight of the outer contact 4. In addition, since the four ribs 42 abut against the inner surface of the insertion hole 53 of the shell 5, it is possible to ensure the concentricity between the outer contact 4 and the insertion hole 53 of the shell 5. Further, by ensuring the concentricity of the outer contact 4 and the insertion hole 53 of the shell 5, it is possible to improve the signal transmission characteristics of the electrical connector 1.

Although the four ribs 42 are formed at the equal angular intervals on the outer peripheral surface of the base side portion of the body portion 41 in the illustrated embodiment, the number of ribs 42 formed at the equal angular intervals on the outer peripheral surface of the base side portion of the body portion 41 is not limited thereto. Three, five or more ribs 42 may be formed at equal angular intervals on the outer peripheral surface of the base side portion of the body portion 41. By forming at least three ribs 42 at the equal angular intervals on the outer peripheral surface of the base side portion of the body portion 41, it is possible to provide the effect of ensuring the concentricity between the outer contact 4 and the insertion hole 53 of the shell 5.

The pair of positioning protrusions 43 are provided for regulating the attachment angle of the outer contact 4 with respect to the shell 5. Each of the pair of positioning protrusions 43 is a plate-like portion formed so as to linearly extend from the outer peripheral surface of the body portion 41 toward the outside. The pair of positioning protrusions 43 face each other through a gap therebetween. Each of the pair of positioning protrusions 43 has a base end portion integrated with the outer peripheral surface of the body portion 41 and linearly extends in a radial direction of the body portion 41. A height of each of the pair of positioning protrusions 43 is higher than a height of each of the four ribs 42 formed on the outer peripheral surface of the body portion 41. The outer contact 4 is press-fitted into the insertion hole 53 of the shell 5 with a posture that the pair of positioning protrusions 43 are inserted into an after-mentioned positioning concave portion 531 (see FIG. 21) of the shell 5. Thus, the attachment angle of the outer contact 4 with respect to the shell 5 is regulated.

Referring back to FIG. 7, the shell 5 has a function as a housing for containing each component of the electrical connector 1 therein and a function as an electrical path for electrically connecting the four outer contacts 4 and a ground terminal 110 on the circuit board 100. As shown in FIGS. 19 and 20, the shell 5 is a box-like member made of a metallic material. The shell 5 includes a body portion 51 constituted of a front plate 511, a pair of side walls 512 and a top plate 513, a press-fitting convex portion 52 formed on a tip end surface of the front plate 511 of the body portion 51, the four insertion holes 53 passing through the front plate 511 of the body portion 51 and the press-fitting convex portion 52, four press-fitting concave portions 54 formed on the press-fitting convex portion 52, an engagement portion 55 and a pair of stop portions 56 formed on an outer surface of each of the pair of side walls 512, four ground terminals 57 extending from a lower end portion of the body portion 51 toward the lower side and a partition portion 58 for preventing electromagnetic interference between the two lower housings 3L and electromagnetic interference between the two upper housings 3U inside the body portion 51 together with the shield member 6.

The body portion 51 includes the front plate 511, the pair of side walls 512 respectively extending from wide-direction end portions of the front plate 511 toward the base side and the top plate 513 extending from an upper end portion of the front plate 511 toward the base side. The body portion 51 has a box-like shape opened toward the base side and the lower side. The components of the electrical connector 1 are contained in an internal space of the body portion 51 defined by inner surfaces of the front plate 511, the pair of side walls 512 and the top plate 513.

As shown in FIG. 19, the press-fitting convex portion 52 is formed so as to protrude from the tip end surface of the front plate 511 of the body portion 51 toward the tip side. The press-fitting convex portion 52 has a shape corresponding to an after-mentioned press-fitting concave portion 83 (see FIG. 23) of the cover 8. When the cover 8 is attached to the shell 5, the press-fitting convex portion 52 of the shell 5 is press-fitted into the press-fitting concave portion 83 of the cover 8.

The four insertion holes 53 are circular holes formed so as to pass through the front plate 511 of the body portion 51 and the press-fitting convex portion 52 in the insertion and extraction direction of the mating connector 200 (the Z direction). The four outer contacts 4 are respectively press-fitted into the four insertion holes 53 from the tip side. Each of the insertion holes 53 includes the positioning concave portion 531 for receiving the pair of positioning protrusions 43 of the outer contact 4, four first guide portions 532 for respectively guiding the four ribs 42 of the outer contact 4, a stop surface 533 for stopping the insertion of the outer contact 4 and two second guide portions 534 for respectively guiding the upper two of the four ribs 311 of the lower housing 3L or the upper housing 3U.

The positioning concave portion 531 is formed for receiving the pair of positioning protrusions 43 of the outer contact 4. The positioning concave portion 531 is formed on the press-fitting convex portion 52 so as to communicate with the insertion hole 53 and extend in a radial direction of the insertion hole 53. As shown in FIG. 21, the outer contact 4 is press-fitted into the insertion hole 53 of the shell 5 with the posture that the pair of positioning protrusions 43 of the outer contact 4 are located in the positioning concave portion 531. With this configuration, it becomes possible to position the outer contact 4 with respect to the shell 5. In a state that the outer contact 4 is press-fitted into the insertion hole 53 of the shell 5, base end surfaces of the pair of positioning protrusions 43 of the outer contact 4 abut against the positioning concave portion 531 of the shell 5.

A depth (a length in the Z direction) of the positioning concave portion 531 is adjusted so that tip end portions of the pair of positioning protrusions 43 of the outer contact 4 are exposed from the positioning concave portion 531 toward the tip side in the state that the outer contact 4 is press-fitted into the insertion hole 53 of the shell 5. Thus, when the cover 8 is attached to the shell 5, the pair of positioning protrusions 43 of the outer contact 4 are sandwiched between the shell 5 and the cover 8. With this configuration, it is possible to prevent the outer contact 4 from being removed from the insertion hole 53 of the shell 5 and it is possible to prevent the backlash of the outer contact 4 in the insertion hole 53 of the shell 5.

Referring back to FIG. 19, the four first guide portions 532 are concave portions formed in a tip end portion of the insertion hole 53 for respectively guiding the four ribs 42 of the outer contact 4. A depth of each of the four first guide portions 532 gradually decreases from the tip side toward the base side. When the outer contact 4 is press-fitted into the insertion hole 53 of the shell 5 with the posture that the pair of positioning protrusions 43 of the outer contact 4 are located in the positioning concave portion 531, the four ribs 42 of the outer contact 4 respectively contact with the four first guide portions 532. Since the depth of each of the first guide portions 532 gradually decreases from the tip side toward the base side, each of the four ribs 42 of the outer contact 4 is elastically deformed toward the inner side as it slides on the first guide portion 532. This configuration facilitates the press-fitting of the outer contact 4 into the insertion hole 53 of the shell 5. Further, since the four ribs 42 of the outer contact 4 contact with the inner surface of the insertion hole 53 of the shell 5, it is possible to ensure the concentricity between the outer contact 4 and the insertion hole 53 of the shell 5. As described above, by ensuring the concentricity between the outer contact 4 and the insertion hole 53 of the shell 5, it is possible to improve the signal transmission characteristics of the electrical connector 1.

Further, since the four ribs 42 of the outer contact 4 are pressed onto the inner surface of the insertion hole 53 of the shell 5 due to their own elastic restoring force, it is possible to electrically connect the outer contact 4 and the shell 5 with sureness. The shell 5 is electrically connected to the ground terminals 110 of the circuit board 100 through the ground terminals 57 as described later. Thus, by electrically connecting the outer contact 4 and the shell 5 with sureness, it is possible to surely make the electric potential of the outer contact 4 equal to the ground potential. This makes it possible to stabilize the signal transmission characteristics of the electrical connector 1.

In this regard, in the state that the press-fitting of the outer contact 4 into the insertion hole 53 of the shell 5 is completed, tip end portions of the four ribs 42 formed on the body portion 41 of the outer contact 4 protrude from the insertion hole 53 of the shell 5 toward the tip side and are exposed to the outside as shown in FIG. 21. When the cover 8 is attached to the shell 5 from the tip side after the four outer contacts 4 are respectively press-fitted into the insertion holes 53 of the shell 5, the four ribs 42 of the outer contact 4 abut against an inner surface of one of insertion holes 82 (see FIGS. 22 and 23) of the cover 8. With this configuration, it is possible to ensure the concentricity among the insertion hole 53 of the shell 5, the outer contact 4 and the insertion hole 82 of the cover 8.

The stop surface 533 is a flat surface formed in the insertion hole 53 and perpendicular to the insertion and extraction direction of the mating connector 200 (the Z direction). The press-fitting of the outer contact 4 into the insertion hole 53 of the shell 5 is completed when the outer contact 4 abuts against the stop surface 533. A diameter of a portion of the insertion hole 53 positioned more to the front side than the stop surface 533 is substantially equal to an outer diameter of the body portion 41 of the outer contact 4. A diameter of a portion of the insertion hole 53 positioned more to the rear side than the stop surface 533 is substantially equal to an outer diameter of the cylindrical portion 31 of the lower housing 3L or the upper housing 3U.

As shown in FIG. 20, the two second guide portions 534 are concave portions formed on an upper surface of a base side portion of the insertion hole 53 so as to linearly extend in the insertion and extraction direction of the mating connector 200 (the Z direction). When the cylindrical portion 31 of the lower housing 3L or the upper housing 3U is inserted into the insertion hole 53 of the shell 5 from the base side, the upper two of the four ribs 311 formed on the cylindrical portion 31 of the lower housing 3L or the upper housing 3U are respectively inserted into the two second guide portions 534. With this configuration, it is possible to position the lower housing 3L or the upper housing 3U with respect to the shell 5.

Referring back to FIG. 19, the four press-fitting concave portions 54 are concave portions formed on the press-fitting convex portion 52 and respectively positioned on the upper side, the lower side, the left side and the right side of the four insertion holes 53 so as to sandwich the four insertion holes 53 from side to side and up and down. Each of the four press-fitting concave portions 54 has a shape corresponding to each of after-mentioned four convex portions 85 (see FIG. 23) of the cover 8. When the cover 8 is attached to the shell 5, the four convex portions 85 of the cover 8 are respectively press-fitted into the four press-fitting concave portions 54. With this configuration, it is possible to improve prying resistance of the attachment of the cover 8 with respect to the shell 5.

The engagement portion 55 is formed on the outer surface of each of the pair of side walls 512 so as to protrude toward the outside. The engagement portion 55 has a tapered shape whose height gradually increases from the tip side toward the base side and a tip end surface of the engagement portion 55 is a slope. On the other hand, a base end surface of the engagement portion 55 is a flat surface perpendicular to the insertion and extraction direction of the mating connector 200 (the Z direction). The engagement portion 55 engages with an after-mentioned engagement hole 861 (see FIGS. 22 and 23) of the cover 8 to enable the attachment of the cover 8 with respect to the shell 5.

The pair of stop portions 56 are formed on the outer surface of each of the pair of side walls 512 so as to protrude toward the outside. A tip end surface of the stop portion 56 is a flat surface perpendicular to the insertion and extraction direction of the mating connector 200 (the Z direction). When the cover 8 is attached to the shell 5, base end surfaces of a pair of protruding pieces 86 (see FIGS. 22 and 23) of the cover 8 respectively abut against the tip end surfaces of the stop portions 56, and thereby the attachment of the cover 8 with respect to the shell 5 is stopped. When the base end surfaces of the pair of protruding pieces 86 of the cover 8 respectively abut against the tip end surfaces of the stop portion 56, the cover 8 is positioned with respect to the shell 5. In addition, after the cover 8 is attached to the shell 5, the pair of stop portions 56 may be deformed by using a suitable tool so that the deformed stop portions 56 respectively press the protruding pieces 86 of the cover 8 from the outside onto the side wall 512. By performing such an operation, it is possible to prevent the protruding pieces 86 of the cover 8 from being opened toward the outside.

The four ground terminals 57 extend from the lower end portion of the body portion 51 toward the lower side. The four ground terminals 57 are respectively connected to the corresponding ground terminals 110 (see FIG. 3) of the circuit board 100. Since the four ribs 42 of the outer contact 4 are pressed onto the inner surface of the insertion hole 53 of the shell 5 due to their own elastic restoring force as described above, the shell 5 and the outer contact 4 are electrically connected to each other. Further, since the shell 5 is electrically connected to the ground terminals 110 of the circuit board 100 through the ground terminals 57, the electric potential of the outer contact 4 electrically connected to the shell 5 becomes equal to the ground potential.

As shown in FIG. 20, the partition portion 58 is a plate-like portion extending inside the body portion 51 along the inner and extraction direction of the mating connector 200 (the Z direction) so as to partition the insertion holes 53 adjacent to each other in the width direction. The partition portion 58 has a function of preventing the electromagnetic interference between the two lower contact pins 2L and the electromagnetic interference between the two upper contact pins 2U in the state that the two lower housings 3L and the two upper housings 3U are held in the shell 5.

Further, a press-fitting groove 581 into which the shield member 6 is press-fitted is formed on an inner surface of each of the pair of side walls 512 and the partition portion 58. By inserting the shield member 6 into the press-fitting groove 581, it is possible to prevent the electromagnetic interference between the lower contact pins 2L and the upper contact pins 2U adjacent to each other in the insertion and extraction direction of the mating connector 200 (the Z direction). Further, the partition portion 58 of the shell 5, the shield member 6 and the inner surface of the body portion 51 of the shell 5 define two housing containing sections 59 for respectively containing the two lower housings 3L therein.

Further, fitting grooves 582 into which the lid 7 is fitted are formed on a base side portion of the inner surface of each of the pair of side walls 512. By fitting the lid 7 into the fitting grooves 582, the base side portion of the body portion 51 of the shell 5 is closed. The partition portion 58 of the shell 5, the shield member 6, the lid 7 and the inner surface of the body portion 51 of the shell 5 define other two housing containing sections 59 for respectively containing the two upper housings 3U therein.

Referring back to FIG. 7, the shield member 6 has a function of preventing the electromagnetic interference between the lower contact pins 2L and the upper contact pins 2U adjacent to each other in the insertion and extraction direction of the mating connector 200 (the Z direction) when the shield member 6 is press-fitted into the press-fitting groove 581 of the shell 5 from the lower side. The shield member 6 is a plate-like member made of the same or similar metallic material as the constituent material of the shell 5. The shield member 6 includes a plate-like body portion 61, three press-fitting protrusions 62 formed on the body portion 61 and a terminal portion 63 extending from the body portion 61 toward the lower side. The three press-fitting protrusions 62 are formed so as to align in the width direction of the body portion 61. Center one of the three press-fitting protrusions 62 protrudes toward the tip side and left and right two of the three press-fitting protrusions 62 protrude toward the base side. When the shield member 6 is press-fitted into the press-fitting groove 581 of the shell 5, the three press-fitting protrusions 62 are elastically deformed toward the inside and abut against the press-fitting groove 581 of the shell 5. With this configuration, it is possible to prevent the shield member 6 from being removed from the press-fitting groove 581 of the shell 5. The terminal portion 63 extends from the body portion 61 toward the lower side and should be connected to a corresponding shield terminal 130 (see FIG. 3) of the circuit board 100.

The lid 7 has a function of closing a base side opening of the shell 5. The lid 7 is a plate-like member made of the same or similar metallic material as the constituent material of the shell 5. The lid 7 includes a plate-like body portion 71 and two pairs of fitting protrusions 72 respectively formed on both side surfaces of the body portion 71 so as to protrude toward the outside. The lid 7 is attached to the shell 5 by fitting the two pairs of fitting protrusions 72 of the lid 7 into the fitting grooves 582 of the shell 5.

The cover 8 is attached to the shell 5 and has a function of guiding the coupling between the electrical connector 1 and the mating connector 200. As shown in FIGS. 22 and 23, the cover 8 includes a rectangular cylindrical body portion 81 which opens toward the tip side, the four insertion holes 82 formed in a base end surface of the body portion 81, the press-fitting concave portion 83 formed on the base end surface of the body portion 81, four protrusions 84 formed in the press-fitting concave portion 83, the four convex portions 85 protruding from the press-fitting concave portion 83 toward the base side, the pair of protruding pieces 86 extending from the body portion 81 toward the base side and a receiving portion 87 formed on an upper surface of the body portion 81 for receiving a positioning convex portion 211 (see FIG. 3) of the mating connector 200.

The Body portion 81 has a rectangular cylindrical shape which opens toward the tip side. When the mating connector 200 is inserted into a tip side opening of the body portion 81, the coupling between the electrical connector 1 and the mating connector 200 is guided. The four insertion holes 82 are circular openings formed on the base end surface of the body portion 81. When the cover 8 is attached to the shell 5, the four outer contacts 4 protruding from the shell 5 toward the tip side are respectively passed through the insertion holes 82 of the cover 8. At this time, the tip end portions of the four ribs 42 of the outer contact 4 abut against the inner surface of the insertion hole 82 of the cover 8. With this configuration, it is possible to ensure the concentricity among the insertion hole 53 of the shell 5, the outer contact 4 and the insertion hole 82 of the cover 8.

As shown in FIG. 23, the press-fitting concave portion 83 is formed on the base end surface of the body portion 81. The press-fitting concave portion 83 has a shape corresponding to the above-mentioned press-fitting convex portion 52 of the shell 5. When the cover 8 is attached to the shell 5, the press-fitting convex portion 52 of the shell 5 is press-fitted into the press-fitting concave portion 83 of the cover 8, thereby enhancing strength of the attachment of the cover 8 with respect to the shell 5.

The four protrusions 84 are formed in the press-fitting concave portions 83 so as to respectively face the four positioning concave portions 531 of the shell 5 when the cover 8 is attached to the shell 5. Each of the four protrusions 84 has a conical shape whose diameter gradually decreases from the tip side toward the base side. As described above, the pair of positioning protrusions 43 of the outer contact 4 are located in the positioning concave portion 531 of the shell 5 and the tip end portions of the pair of positioning protrusions 43 of the outer contact 4 protrude from the positioning concave portion 531 of the shell 5 toward the tip side. Thus, when the cover 8 is attached to the shell 5, the protrusion 84 contacts with the tip end portions of the pair of positioning protrusions 43 of the outer contact 4. Therefore, when the cover 8 is attached to the shell 5, the pair of positioning protrusions 43 of the outer contact 4 are sandwiched between the cover 8 and the shell 5. With this configuration, it is possible to prevent the outer contact 4 from being removed from the insertion hole 53 of the shell 5 and it is possible to prevent the backlash of the outer contact 4 in the insertion hole 53 of the shell 5.

The four convex portions 85 are formed in the press-fitting concave portions 83 so as to respectively face the four press-fitting concave portions 54 of the shell 5 when the cover 8 is attached to the shell 5. Each of the convex portions 85 has a shape corresponding to the press-fitting concave portion 54 of the shell 5. Thus, when the cover 8 is attached to the shell 5, the four convex portions 85 of the cover 8 are respectively press-fitted into the four press-fitting concave portions 54 of the shell 5. With this configuration, it is possible to improve the prying resistance of the attachment of the cover 8 with respect to the shell 5.

The pair of protruding pieces 86 are plate-like portions respectively extending from width-direction edges of the base end surface of the body portion 81 toward the base side. The pair of protruding pieces 86 face each other through a gap therebetween. Each of the pair of protruding pieces 86 has the engagement hole 861. When the cover 8 is attached to the shell 5 from the tip side for attaching the cover 8 to the shell 5, the pair of protruding pieces 86 respectively slide on the tip end surfaces of the engagement portions 55 respectively formed on the outer surfaces of the pair of side walls 512 of the shell 5. Since the tip end surfaces of the engagement portions 55 of the shell 5 are the slopes as described above, the pair of protruding pieces 86 respectively slide on the engagement portions 55 of the shell 5, and thereby the pair of protruding pieces 86 are opened toward the outside. Thereafter, when the engagement holes 861 of the pair of protruding pieces 86 respectively pass over the engagement portions 55 of the shell 5, the pair of protruding pieces 86 are closed. As a result, the engagement holes 861 of the pair of protruding pieces 86 respectively engage with the engagement portions 55 of the shell 5, and thereby the cover 8 is locked with respect to the shell 5.

The receiving portion 87 is formed on the upper surface of the body portion 81 and has a function of receiving the positioning convex portion 211 of the case 210 of the mating connector 200. The receiving portion 87 includes an opening 871 through which the positioning convex portion 211 of the case 210 of the mating connector 200 is passed, a pair of guide portions 872 between which the positioning convex portion 211 of the mating connector 200 is slid for guiding the coupling between the electrical connector 1 and the mating connector 200 and a stop portion 873 for stopping the positioning convex portion 211 of the case 210 of the mating connector 200.

The opening 871 is a rectangular opening which opens in the insertion and extraction direction of the mating connector 200 (the Z direction). The mating connector 200 is inserted into the electrical connector 1 with a posture that the positioning convex portion 211 of the case 210 of the mating connector 200 is inserted into the opening 871 for positioning the mating connector 200 with respect to the electrical connector 1. The pair of guide portions 872 are plate-like portions extending from the upper surface of the body portion 81 toward the upper side and facing each other. The positioning convex portion 211 of the case 210 of the mating connector 200 slides on inner surfaces of the pair of guide portions 872 for guiding the coupling between the electrical connector 1 and the mating connector 200. The stop portion 873 is a plate-like portion for connecting base end portions of the pair of guide portions 872 to each other. The stop portion 873 is a flat surface perpendicular to the insertion and extraction direction of the mating connector 200 (the Z direction). When the tip end portion of the positioning convex portion 211 of the case 210 of the mating connector 200 abuts against the stop portion 873, the insertion of the mating connector 200 with respect to the electrical connector 1 is restricted.

The electrical connector 1 including the above-described components can be assembled by the following exemplary process. First, the press-fitting tool 400 is used for respectively press-fitting the two lower contact pins 2L into the insertion holes 312 of the two lower housings 3L. Since the insertion of the two lower contact pins 2L into the insertion holes 312 of the two lower housings 3L is performed in the same manner, a process for press-fitting one of the lower contact pins 2L into the insertion hole 312 of one of the lower housings 3L will be described below as a representative.

First, the contact portion 22 of the lower contact pin 2L is inserted into the insertion hole 312 of the lower housing 3L. Next, the pair of protruding portions 410 of the press-fitting tool 400 are brought into contact with the entire areas of the base end surfaces of the pair of press-fitting shoulders 26 of the lower contact pin 2L. Next, the entire areas of the base end surfaces of the pair of press-fitting shoulders 26 of the lower contact pin 2L are respectively pressed by the pair of protruding portions 410 of the press-fitting tool 400 for press-fitting the lower contact pin 2L into the insertion hole 312 of the lower housing 3L. When the downwardly extending portion 24 of the lower contact pin 2L contacts with the rear rib 325 formed on the base end surface of the front plate 321 of the downwardly extending portion 32 of the lower housing 3L, the press-fitting of the lower contact pin 2L into the insertion hole 312 of the lower housing 3L is completed. As described above, in the state that the press-fitting of the lower contact pin 2L into the lower housing 3L is completed, the base end portions 261 of the pair of press-fitting shoulders 26 of the lower contact pin 2L are exposed from the concave portion 33 formed on the base end surface of the cylindrical portion 31 of the lower housing 3L toward the base side. Thus, the pair of protruding portions 410 of the press-fitting tool 400 can respectively press the entire areas of the base end surfaces of the pair of press-fitting shoulders 26 of the lower contact pin 2L until the downwardly extending portion 24 of the lower contact pin 2L contacts with the rear rib 325 of the lower housing 3L and the positioning of the lower contact pin 2L in the lower housing 3L is performed. In the same manner, the two upper contact pins 2U are respectively press-fitted into the insertion holes 312 of the two upper housings 3U.

Next, the four outer contacts 4 are respectively press-fitted into the four insertion holes 53 of the shell 5 from the tip side for attaching the four outer contacts 4 to the shell 5. Since the press-fitting of the four outer contacts 4 into the four insertion holes 53 of the shell 5 is performed in the same manner, a process for press-fitting one of the outer contacts 4 into one of the insertion holes 53 of the shell 5 will be described below as a representative. The outer contact 4 is press-fitted into the insertion hole 53 of the shell 5 from the tip side with the posture that the pair of positioning protrusions 43 of the outer contact 4 are located in the positioning concave portion 531 of the shell 5. When the outer contact 4 is press-fitted into the insertion hole 53 of the shell 5, the four ribs 42 of the outer contact 4 contact with the inner surface of the insertion hole 53 of the shell 5, and thereby the outer contact 4 is fixed in the insertion hole 53 of the shell 5. With this configuration, it is possible to suppress the backlash of the outer contact 4 in the insertion hole 53 of the shell 5 and it is possible to ensure the concentricity between the outer contact 4 and the insertion hole 53 of the shell 5. As described above, by ensuring the concentricity between the outer contact 4 and the insertion hole 53 of the shell 5, it is possible to improve the signal transmission characteristics of the electrical connector 1. Further, since the four ribs 42 of the outer contact 4 are pressed onto the inner surface of the insertion hole 53 of the shell 5 due to their own elastic restoring force, the shell 5 and the outer contact 4 are electrically connected to each other. Since the shell 5 is connected to the ground terminals 110 of the circuit board 100 through the ground terminals 57, the electric potential of the outer contact 4 electrically connected to the shell 5 becomes equal to the ground potential.

Next, the two lower housings 3L are respectively press-fitted into the corresponding insertion holes 53 of the shell 5 from the base side. Since the press-fitting of the two lower housings 3L into the corresponding insertion holes 53 of the shell 5 is performed in the same manner, a process of press-fitting one of the lower housings 3L into one of the insertion holes 53 of the shell 5 will be described below as a representative. First, the cylindrical portion 31 of the lower housing 3L is press-fitted into the corresponding insertion hole 53 of the shell 5 from the base side. The press-fitting of the lower housing 3L into the corresponding insertion hole 53 of the shell 5 is completed when the front rib 323 of the lower housing 3L contacts with the inner surface of the body portion 51 of the shell 5. In the state that the press-fitting of the lower housing 3L into the corresponding insertion hole 53 of the shell 5 is completed, the four ribs 311 formed on the cylindrical portion 31 of the lower housing 3L contact with the inner surface of the corresponding insertion hole 53 of the shell 5. Thus, the cylindrical portion 31 of the lower housing 3L is fixed in the corresponding insertion hole 53 of the shell 5. With this configuration, it is possible to suppress the backlash of the cylindrical portion 31 of the lower housing 3L in the corresponding insertion hole 53 of the shell 5 and it is possible to ensure the concentricity between the cylindrical portion 31 of the lower housing 3L and the corresponding insertion hole 53 of the shell 5. Further, by ensuring the concentricity between the cylindrical portion 31 of the lower housing 3L and the corresponding insertion hole 53 of the shell 5, it is possible to improve the signal transmission characteristics of the electrical connector 1. Furthermore, since the pair of lateral ribs 324 formed on the downwardly extending portion 32 of the lower housing 3L contact with the inner surface of the body portion 51 of the shell 5, it is possible to suppress the backlash of the downwardly extending portion 32 of the lower housing 3L in the body portion 51 of the shell 5. In the same manner, the two upper housings 3U are respectively press-fitted into the corresponding insertion holes 53 of the shell 5 from the base side.

Next, the shield member 6 is press-fitted into the press-fitting groove 581 of the shell 5 from the lower side. With this operation, the two housing containing sections 59 for respectively containing the two lower housings 3L therein are defined by the partition portion 58 of the shell 5, the shield member 6 and the inner surface of the body portion 51 of the shell 5. In the state that the two lower housings 3L are respectively contained in the two housing containing sections 59, the lower contact pins 2L respectively inserted into the lower housings 3L are surrounded by metallic conductive members, that is the shell 5 and the shield member 6. Therefore, it is possible to prevent the electromagnetic interference with respect to each of the lower contact pins 2L.

Next, the lid 7 is attached to the shell 5 by respectively fitting the fitting protrusions 72 of the lid 7 into the fitting grooves 582 of the shell 5 from the base side. The two housing containing sections 59 for respectively containing the two upper housings 3U therein are defined by the partition portion 58 of the shell 5, the shield member 6, the lid 7 and the inner surface of the body portion 51 of the shell 5. In the state that the two upper housings 3U are respectively contained in the two housing containing sections 59, the upper contact pins 2U respectively inserted into the upper housings 3U are surrounded by the metallic conductive elements, that is the shell 5, the shield member 6 and the lid 7. Thus, it is possible to prevent the electromagnetically interfered with respect to each of the upper contact pins 2U. In addition, by closing the base side portion of the shell 5 with the lid 7, the two lower contact pins 2L and the two upper contact pins 2U contained in the shell 5 are covered by the members made of the conductive material from the tip side, the base side, the both lateral sides and the upper side except the lower side on which the terminal portions 25 extend toward the outside. By surrounding the two lower contact pins 2L and the two upper contact pins 2U contained in the shell 5 by the members made of the conductive material as described above, it is possible to improve the effect of preventing the electrical interference with respect to the two lower contact pins 2L and the two upper contact pins 2U, and thereby improving the characteristic s impedance of the electrical connector 1.

Finally, the cover 8 is attached to the shell 5 from the tip side. Specifically, the four outer contacts 4 are respectively passed through the four corresponding insertion holes 82 of the cover 8 and the press-fitting convex portion 52 of the shell 5 is press-fit into the press-fitting concave portion 83 formed on the base end surface of the body portion 81 of the cover 8. Further, when the engagement holes 861 respectively formed in the pair of protruding pieces 86 of the cover 8 are respectively engaged with the engagement portions 55 respectively formed on the pair of side walls 512 of the body portion 51 of the shell 5 and thus the cover 8 is locked with respect to the shell 5, the attachment of the cover 8 with respect to the shell 5 is completed. In the state that the cover 8 is attached to the shell 5, the four convex portions 85 of the cover 8 are respectively press-fitted into the four press-fitting concave portions 54 of the shell 5. With this configuration, it is possible to improve the praying resistance of the attachment of the cover 8 with respect to the shell 5.

As described above, the pair of positioning protrusions 43 of the outer contact 4 are located in the positioning concave portion 531 of the shell 5 and the tip end portions of the pair of positioning protrusions 43 of the outer contact 4 protrude from the positioning concave portion 531 of the shell 5 toward the tip side. Thus, in the state that the cover 8 is attached to the shell 5, the protrusions 84 of the cover 8 contact with the tip end portions of the pair of positioning protrusions 43 of the outer contact 4. Therefore, the pair of positioning protrusions 43 of the outer contact 4 are sandwiched between the cover 8 and the shell 5. With this configuration, it is possible to prevent the outer contact 4 from being removed from the insertion hole 53 of the shell 5 and it is possible to prevent the backlash of the outer contact 4 in the insertion hole 53 of the shell 5.

Further, in the state that the press-fitting of the outer contact 4 into the insertion hole 53 of the shell 5 is completed, the tip end portions of the four ribs 42 formed on the body portion 41 of the outer contact 4 protrude from the insertion hole 53 of the shell 5 toward the tip side as described above. Thus, in the state that the cover 8 is attached to the shell 5, the four ribs 42 of the outer contact 4 abut against the inner surface of the insertion hole 82 of the cover 8. With this configuration, it is possible to ensure the concentricity among the insertion hole 53 of the shell 5, the outer contact 4 and the insertion hole 82 of the cover 8. Although the description has been given to one example of the process of assembling the electrical connector 1, the process of assembling the electrical connector 1 of the present disclosure is not limited thereto. Arbitrary appropriate process can be used for assembling the electrical connector 1.

FIG. 24 is a YZ plane cross-sectional view containing the lower contact pin 2L and the upper contact pin 2U in the state that the electrical connector 1 and the mating connector 200 are coupled with each other. As shown in FIG. 24, when the mating connector 200 is inserted into the electrical connector 1 from the tip side and the positioning convex portion 211 of the case 210 of the mating connector 200 abuts against the stop portion 873 of the electrical connector 1, the electrical connector 1 and the mating connector 200 are coupled with each other. In this state, the contact portions 22 of the lower contact pins 2L and the upper contact pins 2U of the electrical connector 1 respectively contact with the corresponding contact pins 220 of the mating connector 200. The contact pins 220 of the mating connector 200 are respectively connected to the core wires 310 of the corresponding coaxial cables 300. Thus, in the state that the electrical connector 1 and the mating connector 200 are coupled with each other, the lower contact pins 2L and the upper contact pins 2U of the electrical connector 1 are electrically connected to the core wires 310 of the corresponding coaxial cables 300 through the corresponding contact pins 220 of the mating connector 200, respectively.

Further, the outer contacts 4 of the electrical connector 1 respectively contact with the corresponding outer contacts 230 of the mating connector 200. The outer contacts 230 of the mating connector 200 are respectively connected to the outer conductor layers 330 of the corresponding coaxial cables 300. Thus, in the state that the electrical connector 1 and the mating connector 200 are coupled with each other, the outer contacts 4 of the electrical connector 1 are electrically connected to the outer conductor layers 330 of the corresponding coaxial cable 300 through the corresponding outer contacts 230 of the mating connector 200, respectively. With this configuration, the electrical connector 1 is coaxially connected to the four coaxial cables 300 through the mating connector 200.

The width of each of the pair of press-fitting shoulders 26 of the lower contact pins 2L and the upper contact pins 2U of the electrical connector 1 of the present disclosure gradually decreases from the base side toward the tip side as described above. Further, the pair of press-fitting shoulders 26 of the lower contact pins 2L or the upper contact pins 2U face the bottom surface 331 of the concave portion 33 of the lower housing 3L or the upper housing 3U through the gap therebetween. Thus, the air layer exists between the pair of press-fitting shoulders 26 of the lower contact pin 2L and the bottom surface 331 of the concave portion 33 of the lower housing 3L and between the pair of press-fitting shoulders 26 of the upper contact pin 2U and the bottom surface 331 of the concave portion 33 of the upper housing 3U. With this configuration, it is possible to suppress the decrease of the impedance of the portion where the pair of press-fitting shoulders 26 of the lower contact pin 2L or the upper contact pin 2U are formed. As a result, it is possible to improve the signal transmission characteristics of the electrical connector 1, in particular, the signal transmission characteristics of the electrical connector 1 in the high frequency band.

Further, the thickness of the air layer between the pair of press-fitting shoulders 26 of the lower contact pin 2L and the bottom surface 331 of the concave portion 33 of the lower housing 3L and between the pair of press-fitting shoulders 26 of the upper contact pin 2U and the bottom surface 331 of the concave portion 33 of the upper housing 3U gradually increases from the tip side toward the base side. With this configuration, it is possible to more effectively suppress the decrease of the impedance of the portion where the pair of press-fitting shoulders 26 of the lower contact pin 2L or the upper contact pin 2U are formed. As a result, it is possible to more effectively improve the signal transmission characteristics of the electrical connector 1, in particular, the signal transmission characteristics of the electrical connector 1 in the high-frequency band.

Although the electrical connector of the present disclosure has been described with reference to the illustrated embodiment, the present disclosure is not limited thereto. Each configuration of the present disclosure can be replaced with arbitrary configuration capable of performing the same or similar function, or arbitrary configuration can be added to each configuration of the present disclosure.

A person having ordinary skills in the art and the technique pertaining to the present disclosure may modify the configuration of the electrical connector of the present disclosure described above without meaningfully departing from the principle, the spirit and the scope of the present disclosure and the electrical connector having the modified configuration is also involved in the scope of the present disclosure.

In addition, the number and types of the components of the electrical connector shown in the drawings are merely illustrative example and the present disclosure is not necessarily limited thereto. An aspect in which any component is added or combined or any component is omitted without departing from the principle and intent of the present disclosure is also involved within the scope of the present disclosure.

Figure 25:
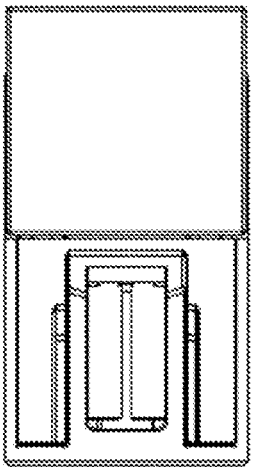
FIG. 25 is a top view of the electrical connector of the present disclosure.
Figure 26:
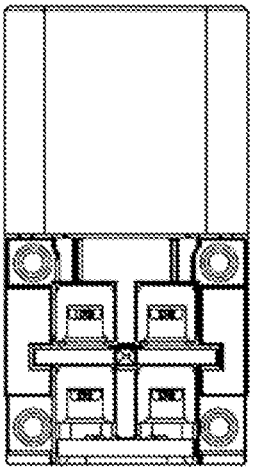
FIG. 26 is a bottom view of the electrical connector of the present disclosure.
Figure 27:
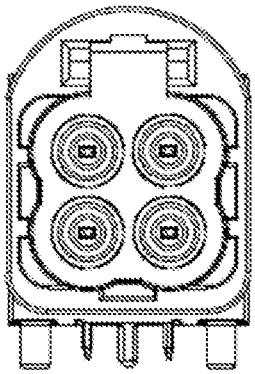
FIG. 27 is a front view of the electrical connector of the present disclosure.
Figure 28:
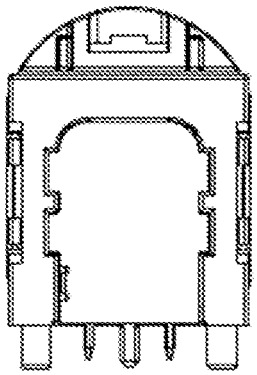
FIG. 28 is a rear view of the electrical connector of the present disclosure.
Figure 29:
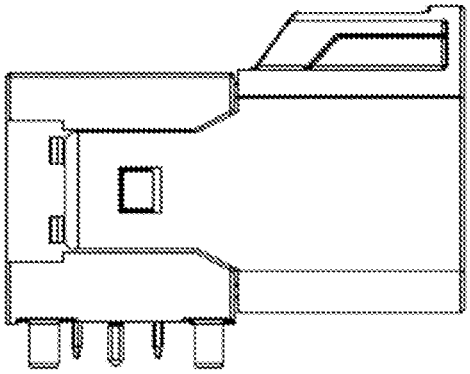
FIG. 29 is a left side view of the electrical connector of the present disclosure.
Figure 30:
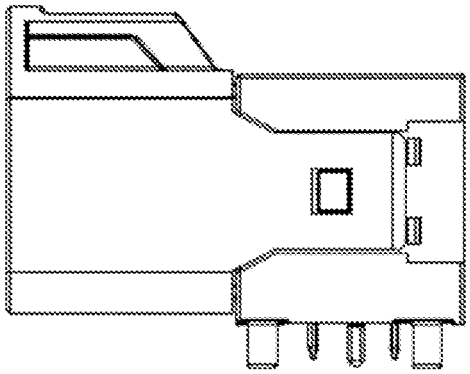
FIG. 30 is a right side view of the electrical connector of the present disclosure.

In addition, FIGS. 25 to 30 show six side views of the electrical connector according to the embodiment of the present disclosure for reference. FIG. 25 is a top view of the electrical connector of the present disclosure. FIG. 26 is a bottom view of the electrical connector of the present disclosure. FIG. 27 is a front view of the electrical connector of the present disclosure. FIG. 28 is a rear view of the electrical connector of the present disclosure. FIG. 29 is a left side view of the electrical connector of the present disclosure. FIG. 30 is a right side view of the electrical connector of the present disclosure.

The invention claimed is:

1. An electrical connector which can be coupled with a mating connector inserted from a tip side, comprising:

a contact pin;

an insulating housing for containing the contact pin therein; and a metallic outer contact for covering the housing, wherein the contact pin includes:

a horizontally extending portion which is located in the housing and linearly extends in an insertion and extraction direction of the mating connector, a contact portion which linearly extends from a tip end portion of the horizontally extending portion toward the tip side so as to be exposed from the housing, a connection portion which is curved from a base end portion of the horizontally extending portion so as to extend toward a lower side, a downwardly extending portion which linearly extends from a lower end portion of the connection portion toward the lower side, and at least one press-fitting shoulder which extends from a side portion of the base end portion of the horizontally extending portion in a width direction perpendicular to the insertion and extraction direction of the mating connector, wherein a width of the at least one press-fitting shoulder of the contact pin decreases from a base side toward the tip side, wherein the housing includes a cylindrical portion linearly extending in the insertion and extraction direction of the mating connector and a downwardly extending portion extending from a base end portion of the cylindrical portion toward the lower side, wherein the cylindrical portion of the housing includes an insertion hole through which the contact pin is passed and a concave portion formed on a base end surface of the cylindrical portion so as to open toward the base side and communicate with the insertion hole, wherein the at least one press-fitting shoulder of the contact pin is contained in the concave portion of the cylindrical portion of the housing, wherein the concave portion of the cylindrical portion of the housing is defined by a bottom surface directed toward the base side and wall portions extending from the bottom surface toward the base side, and wherein the at least one press-fitting shoulder of the contact pin faces the bottom surface of the concave portion of the cylindrical portion of the housing through a gap therebetween, and thereby an air layer exists between the at least one press-fitting shoulder of the contact pin and the bottom surface of the concave portion of the cylindrical portion of the housing.

2. The electrical connector as claimed in claim 1, wherein the bottom surface of the concave portion of the cylindrical portion of the housing is a flat surface perpendicular to the insertion and extraction direction of the mating connector.

3. The electrical connector as claimed in claim 1, wherein a base end portion of the at least one press-fitting shoulder of the contact pin protrudes from the concave portion of the cylindrical portion of the housing toward the base side.

* * * * *